US007734241B2

(12) United States Patent
Nishida et al.

(10) Patent No.: US 7,734,241 B2
(45) Date of Patent: Jun. 8, 2010

(54) IMAGE HEATING APPARATUS AND ROTATABLE HEATING MEMBER USED FOR THE SAME

(75) Inventors: Satoshi Nishida, Numazu (JP); Ken-ichi Ogawa, Numazu (JP); Akira Kato, Mishima (JP); Isamu Takeda, Suntou-gun (JP); Katsuhisa Matsunaka, Inagi (JP); Atsuyoshi Abe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 12/110,600

(22) Filed: Apr. 28, 2008

(65) Prior Publication Data

US 2008/0273904 A1 Nov. 6, 2008

(30) Foreign Application Priority Data

May 1, 2007 (JP) ..... 2007-120516
Apr. 14, 2008 (JP) ..... 2008-104577

(51) Int. Cl.
*G03G 15/20* (2006.01)

(52) U.S. Cl. ..... 399/333; 430/124.32

(58) Field of Classification Search ..... 399/328, 399/330, 331, 333; 219/216; 430/124.3, 430/124.32, 124.35
See application file for complete search history.

(56) References Cited

U.S. PATENT DOCUMENTS 4,329,565 A * 5/1982 Namiki et al. ..... 219/216
5,893,042 A * 4/1999 Lohmann et al. ..... 701/111
6,282,399 B1 * 8/2001 Tokimatsu et al. ..... 399/330
6,408,160 B1 * 6/2002 Saito et al. ..... 399/333
6,582,222 B1 * 6/2003 Chen et al. ..... 432/60
6,608,641 B1 * 8/2003 Alexandrovich et al. .... 347/131
6,904,258 B2 * 6/2005 Tani et al. ..... 399/329
7,276,674 B2 * 10/2007 Cao et al. ..... 219/216
7,302,220 B2 * 11/2007 Chen et al. ..... 399/333

FOREIGN PATENT DOCUMENTS

JP 57146280 A * 9/1982
JP 6-75491 3/1994
JP 2002-123117 4/2002
JP 2002158083 A * 5/2002
JP 2004-101865 4/2004
JP 2004-317788 11/2004

OTHER PUBLICATIONS

Office Action in Chinese Application No. 200810094945.9, dated Dec. 18, 2009.

* cited by examiner

*Primary Examiner*—Robert Beatty
(74) *Attorney, Agent, or Firm*—Fitzpatrick, Cella, Harper & Scinto

(57) ABSTRACT

Disclosed is an image heating apparatus. The image heating apparatus includes a rotatable heating member for heating an image on a recording material in a nip portion, and a heating unit for heating the heating member from the outside thereof. With this structure, a warm-up time period or a first print-out time period can be reduced, and low power consumption can be accomplished. Further, satisfactory image quality can be realized with no heating (fixing) irregularity. The heating member has a low thermal conductive elastic layer, and a heat storage layer outside the low thermal conductive elastic layer to have a volume heat capacity larger than the low thermal conductive elastic layer. A heat capacity of the heat storage layer per unit surface area of a fixing member is in a range of 100 J/m$^2$K to 600 J/m$^2$K.

6 Claims, 19 Drawing Sheets

IMAGE HEATING APPARATUS AND ROTATABLE HEATING MEMBER USED FOR THE SAME

BACKGROUND OF THE INVENTION

1. Field of the Invention

The present invention relates to an image heating apparatus adapted for use as a heat fixing apparatus to be mounted on an image forming apparatus, such as a printer or a copying machine, utilizing electrophotography technology or electrostatic recording technology.

In addition, the present invention relates to a rotatable heating member that is employed by the image heating apparatus.

As such an image heating apparatus, there are a fixing apparatus for fixing an unfixed image on a recording material, a glossiness enhancing apparatus for increasing a glossiness of an image by heating an image fixed on a recording material, and so on, for example.

2. Description of the Related Art

In the image forming apparatus, a fixing apparatus is used in order to heat and fix an unfixed toner image formed and carried on a recording material to the recording material. As such a fixing apparatus, the fixing apparatus of a contact heating type is widely used. In the contact heating type fixing apparatus, a rotatable heating member (hereinafter, referred to as fixing roller) heated at a predetermined temperature is brought into contact with the recording material in a nip portion. In this way, the unfixed toner image on the recording material is heated and fixed to the recording medium so as to form a fixed image.

The fixing roller may be heated by one of an inside heating type and an outside heating type (surface heating type). In the internal heating type, a heating unit (heat source: heater) is disposed in the fixing roller, and the fixing roller is heated from the inside thereof so as to heat the surface of the fixing roller at a predetermined fixing temperature. In the outside heating type, a heating unit is disposed outside the fixing roller, and the fixing roller is heated from the outside thereof so as to heat the surface of the fixing roller at a predetermined fixing temperature.

The outside heating type fixing apparatus heats the fixing roller from the outside thereof by a heating unit of a small heat capacity, such as a heat roller of a small diameter having a small ceramic heater or a halogen heater. According to the outside heating type fixing apparatus, it is possible to rapidly increase the surface temperature of the fixing roller, thereby reducing a warm-up time period, as compared with the internal heating type fixing apparatus.

Japanese Patent Application Laid-Open No. H06-075491 discusses a fixing roller (heat roller) for outside heating configured to reduce a time period required to increase temperature to a fixable temperature. That is, the fixing roller includes a core metal, a heat insulating layer, a heat transfer layer, and a surface layer (toner release layer). The heat insulating layer is made of silicon rubber to have elasticity at the outer periphery of the core metal. The heat transfer layer is made of a metallic material to have a thickness of 5 μm to 100 μm at the outer periphery of the heat insulating layer. The surface layer is made of fluorine resin to have a thickness of 5 μm to 30 μm at the outer periphery of the heat transfer layer.

The fixing roller has elasticity, such that a high-quality image with no fixing irregularity can be formed. In addition, the surface of the fixing roller is heated, and thus even if the elastic layer is provided below the surface layer of the fixing roller, it is possible to rapidly increase the surface temperature of the fixing roller.

Japanese Patent Application Laid-Open No. 2002-123117 and Japanese Patent Application Laid-Open No. 2004-317788 discuss a construction that a high thermal conductive silicon rubber layer is disposed between a heat insulating elastic layer and a release layer.

By increasing thermal conductivity near the surface layer of the fixing roller, heat from an external heating unit is easily transferred, and thus the surface temperature of the fixing roller is rapidly increased. Therefore, a warm-up time period can be reduced.

Japanese Patent Application Laid-Open No. 2004-101865 discusses an image forming apparatus including a fixing member and a pressure member pressed into contact with the fixing member, a recording material being heated in a pressure nip portion pinched therein. Each of the fixing member and the pressure member is provided with a heat insulating elastic layer, a high thermal conductive silicon rubber layer, and a high thermal conductive release layer. A heat roller serving as an external heating unit comes into contact with the fixing member and the pressure member. Then, heat is applied to both sides of the recording material, that is, a side on which an unfixed toner is carried (hereinafter, this is referred to as a foreside, and the other side is referred to as a backside), and the backside.

Japanese Patent Application Laid-Open No. 2004-101865 also defines thermal conductivity of a high thermal conductive solid rubber layer and a heat insulating elastic layer in order to reduce the warm-up time period. With this construction, the warm-up time period can be reduced not more than 60 seconds.

In the outside heating type, however, a heating unit is not provided in the image forming apparatus, or only the fixing roller is provided with a heating unit. Accordingly, if the fixing roller and the pressure member have small heat capacity in order to reduce the warm-up time period, the following problems may occur.

That is, when the fixing roller that is not provided with a heat source therein comes into contact with the recording material to transfer heat thereto, the surface temperature of the fixing roller is decreased. For this reason, if the surface of the fixing roller is not heated by the heating unit at a significantly high temperature, a sufficient heat amount may not be applied to the recording material.

The available surface temperature of the fixing roller surface is limited to be not more than a predetermined temperature in view of heat resistance of the fixing roller, a temperature detection element, and a safety element. For example, even if silicon rubber having high heat resistance is used for the elastic layer of the fixing roller, when the fixing roller is successively used at high temperature of not less than 230° C., rubber is deteriorated and may be destroyed. The fixing roller needs to secure a sufficient heat amount required for heating and fixing in the fixing nip portion at a temperature less than 230° C.

If a high thermal conductive layer is provided near the surface of the fixing roller, a temperature near the fixing roller can be effectively increased by the heating unit. In this case, however, if the surface temperature of the fixing roller required for heating and fixing is excessively high, the fixing roller may not be used safely and stably.

For this reason, if heat capacity near the surface of the fixing roller is not appropriate, in addition to internal heat insulation performance and high thermal conductivity near the surface, the fixing roller may not store a heat amount required for heating and fixing toner to the recording material.

The discussions on the known outside heating type fixing apparatus have not suggested the appropriate heat capacity near the surface of the fixing roller.

The discussions on the known outside heating type fixing apparatus relate to a heating apparatus in which the warm-up time period is approximately 60 seconds. At present, there is a need for an image heating apparatus in which power is not consumed during a standby state, and it takes a short time period from when a print signal is received until the recording material on which an unfixed toner image is formed is heated and fixed. This time period is usually not more than 20 seconds.

A low thermal conductive layer is provided in the fixing roller, and the fixing roller is heated from the surface thereof. However, the expected warm-up time period is so long that heat reaches the inside of the fixing roller, not only the surface thereof. In this case, it is not taken into consideration that heating and fixing are performed with a heat amount stored near only the surface of the fixing roller within a shot warm-up time period of not more than 20 seconds.

The known outside heating type heat fixing apparatus has not been embodied as an apparatus that does not consume power during the standby state, sufficiently reduces the time period from when the print signal is received until the recording material on which the unfixed toner image is formed is heated and fixed, and achieves sufficient fixing performance for the recording material.

The time period from when the print signal is received until the recording material on which the unfixed toner image is formed is heat fixed is hereinafter referred to as a first print-out time period.

SUMMARY OF THE INVENTION

The present invention is directed to an image heating apparatus configured to reduce a first print-out time period, and a heating member employed by the image heating apparatus.

According to an aspect of the present invention, there is provided an image heating apparatus that heats a toner image on a recording material. The image heating apparatus includes a rotatable heating member, the surface of which comes into contact with the toner image, the heating member having a heat insulating elastic layer and a heat storage layer, which is provided outside the elastic layer and has at least one layer, a nip forming member that forms a nip portion to pinch and convey the recording material with the heating member, and a heater for heating the heating member from the outside thereof. A heat capacity C/S per unit surface area of the heat storage layer is in a range of 100 J/($m^2$·K) to 600 J/($m^2$·K).

According to another aspect of the present invention, there is provided a heating member that is employed by an image heating apparatus. The heating member includes a heat insulating elastic layer, and a heat storage layer that is provided outside the elastic layer and has at least one layer. The image heating apparatus includes a rotatable heating member, the surface of which comes into contact with a toner image on a recording material, a pressure member that forms a nip portion to pinch and convey the recording material with the heating member, and a heater that heats the heating member from the outside thereof. A heat capacity C/S per unit surface area of the heat storage layer is in a range of 100 J/($m^2$·K) from 600 J/($m^2$·K).

Further features of the present invention will become apparent from the following description of exemplary embodiments with reference to the attached drawings.

BRIEF DESCRIPTION OF THE DRAWINGS

(FIGS. 27A and 27B: a heat capacity C/S per unit surface area is larger than 600 J/($m^2$·K)), and a case where a heat capacity of a heat storage layer is appropriate (FIG. 27C: C/S is not more than 600 J/($m^2$·K)).

DESCRIPTION OF THE EMBODIMENTS

Preferred embodiments of the present invention will now be described in detail in accordance with the accompanying drawings.

First Embodiment

(1) Example of Image Forming Apparatus

Figure 2:
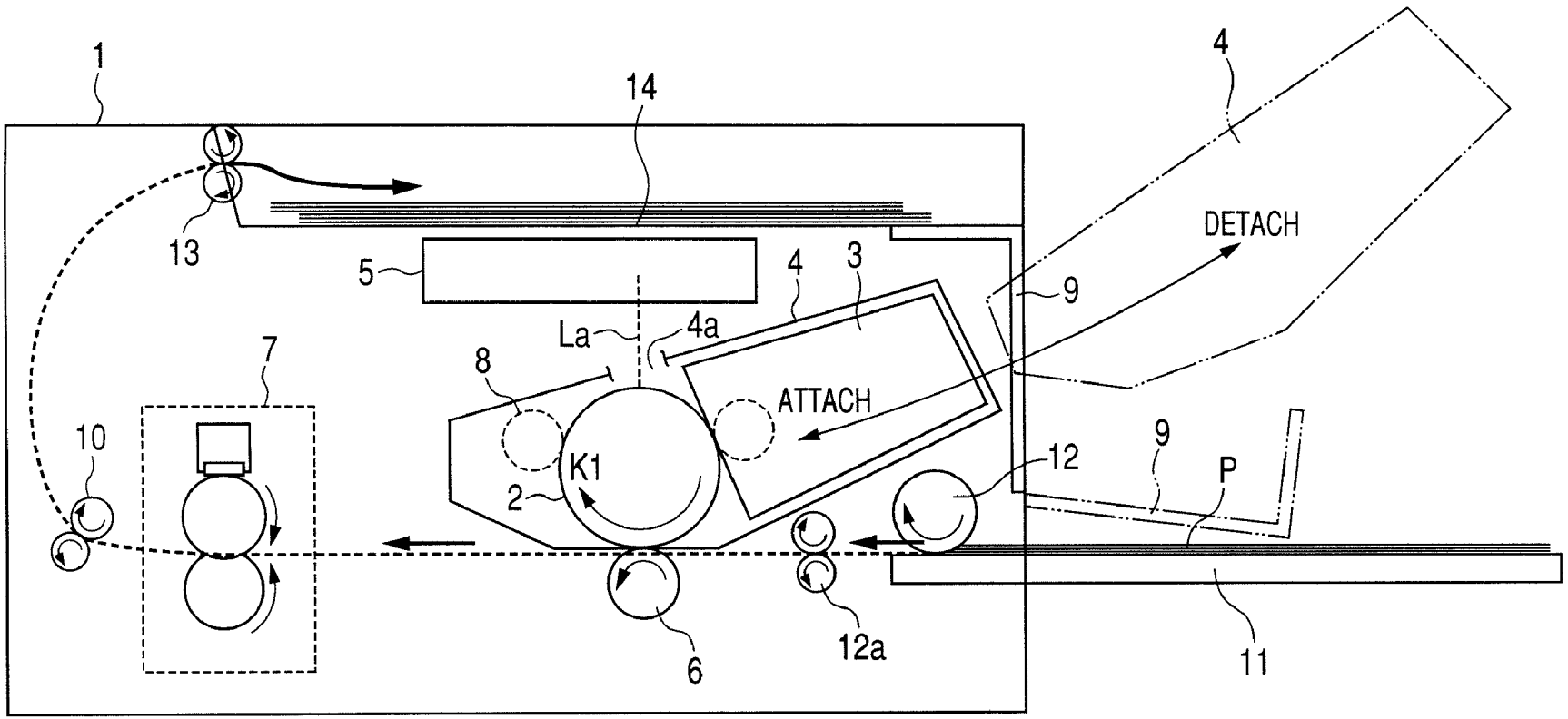
FIG. 2 is a schematic cross-sectional view of an image forming apparatus according to the first embodiment.

FIG. 2 is a schematic cross-sectional view illustrating a schematic construction of a laser beam printer (hereinafter, simply referred to as 'printer') 1 as an image forming apparatus according to this embodiment.

The printer 1 receives image information from an image information providing apparatus (not shown), such as a host computer disposed outside the printer 1. The printer 1 performs a series of image forming processes for forming an image on a sheet-like recording material (recording medium) P according to the received image information by a known electrophotographic system.

The printer 1 includes a process cartridge 4 that holds a drum-shaped rotatable electrophotographic photosensitive member (hereinafter, simply referred to as 'photosensitive member') 2 serving as a latent image bearing member, a primary charging mechanism 8, and a developing device 3. Further, the printer 1 includes a laser scanner unit (hereinafter, simply referred to as 'scanner') 5 that forms an electrostatic latent image corresponding to the image information on an outer peripheral surface of the photosensitive member 2 by an exposure process according to the image information input from the image information providing apparatus. The printer 1 further includes a roll-shaped rotatable transfer member 6 that effects a process to transfer an image to a recording material P, and a fixing apparatus 7 serving as an image heating apparatus that effects a fixing process with heat and pressure on the recording material P to which the image was transferred.

The process cartridge 4 is detachably supported by a printer main body. The printer main body forms a part of the image forming apparatus excluding the process cartridge. When repair of the photosensitive member 2 and maintenance, such as replenishment of a developer to the developing device 3, are required, after a cover 9 that is openably and closably supported by the printer main body is opened, the process cartridge 4 can be replaced with a new process cartridge, thereby performing the maintenance quickly and easily.

The primary charging mechanism 8 is adapted to charge the outer peripheral surface of the photosensitive member 2 during rotation to the regulated potential distribution by applying a regulated bias from the commercial power supply before the exposure process of the scanner 5.

The scanner 5 outputs laser La that is modulated according to time period-series electric digital image signals of the image information from the image information providing apparatus. A charged area on the outer peripheral surface of the photosensitive member 2 is scanned and exposed by laser La through a window 4*a* provided in the process cartridge. Accordingly, the electrostatic latent image corresponding to the image information is formed on the outer peripheral surface of the photosensitive member 2.

Next, a series of image forming processes in the printer 1 will be described. When a start button (not shown) provided in the printer is pushed, the photosensitive member 2 starts to rotate. The photosensitive member 2 is rotated at a regulated peripheral speed in a clockwise direction represented by an arrow K1. Simultaneously, the outer peripheral surface of the photosensitive member 2 is charged to the regulated potential distribution by the primary charging mechanism 8 to which the regulated bias is applied.

Next, the charged area on the outer peripheral surface of the photosensitive member 2 is scanned and exposed by the scanner 5 according to the image information from the image information providing apparatus. Accordingly, the electrostatic latent image corresponding to the image information is formed on the charged area of the photosensitive member 2. The electrostatic latent image is developed by the developer of the developing device 3 and visualized as a toner image.

Meanwhile, the recording material P is fed from a feed cassette 11 one at a time period by a feed roller 12 which is driven at a predetermined timing. The feed cassette 11 contains a plurality of sheets of recording materials P stacked therein. The feed cassette 11 is detachably supported by the printer. The recording material P supplied from the feed cassette 11 is fed to a transfer nip portion formed between the photosensitive member 2 and the transfer member 6 by a pair of resist rollers 12*a* at a predetermined control timing, and is pinched and conveyed through the transfer nip portion. While the recording material P is pinched and conveyed through the transfer nip portion, the toner image on the photosensitive member 2 is sequentially transferred to the recording material P by the transfer member 6.

After the recording material P to which the toner image was transferred is subjected to the toner image heating and fixing process in the fixing apparatus 7, passes through a rotatably supported fixing discharge portion 10, and is discharged out of the printer by a discharge portion 13. The discharged recording material P is rested on a tray 14 attached to the top surface of the printer. In this way, the series of image forming processes are completed.

(2) Fixing Apparatus 7

Figure 1:
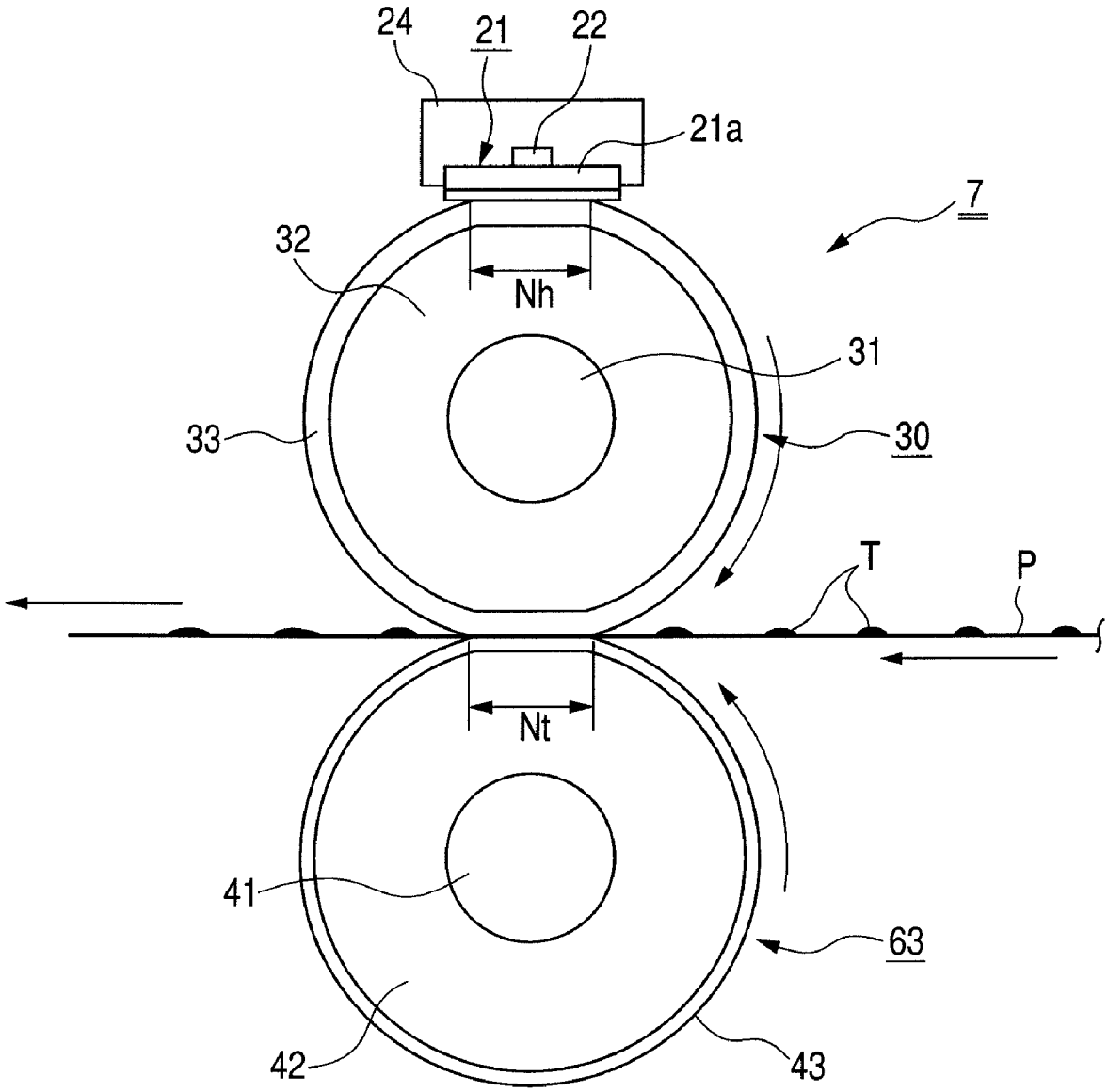
FIG. 1 is a schematic cross-sectional view of a fixing apparatus according to a first embodiment of the present invention.

FIG. 1 is a schematic cross-sectional view of a fixing apparatus 7 as an outside heating type image heating apparatus according to this embodiment.

A fixing roller (fixing rotary member) 30 serves as a rotatable heating member, and is heated from the outside thereof to heat an image on the recording material in the nip portion. A rotatable pressure roller 63 serves as a pressure member.

The fixing roller 30 is substantially arranged in parallel with the pressure roller 63 in a vertical direction and pressed into contact with the pressure roller 63 by a pressure spring (not shown) provided at one end thereof. Accordingly, a fixing nip portion (pressure nip portion) Nt of a predetermined width is formed between the fixing roller 30 and the pressure roller 63 in a direction in which the recording material is conveyed.

The fixing roller 30 is rotated by a drive unit (not shown) at a regulated peripheral speed in a clockwise direction represented by an arrow. The pressure roller 63 is rotated by the rotation of the fixing roller 30. The fixing roller 30 and the pressure roller 63 may be rotated separately.

A heating unit (heat source) 21 heats the fixing roller 30 from the outside thereof. In this embodiment, the heating unit 21 is a plate-shaped heater (hereinafter, simply referred to as 'heater'). The heater 21 is fixedly held by a heater holder 24 and arranged above the fixing roller 30 such that its longitudinal direction is in parallel with the axial direction of the fixing roller 30. The holder 24 is urged by a pressure mechanism (not shown) such that the heater 21 is pressed into contact with the top surface of the fixing roller 30 with predetermined pressure. That is, the heater 21 comes into contact with the fixing roller 30 in the same area. A heating contact region Nh of a predetermined width is formed between the heater 21 and the fixing roller 30 in the rotation direction of the fixing roller 30.

A length (in a direction perpendicular to the drawing) of a roller portion including the fixing roller 30 and the pressure roller 63, and a length (in a direction perpendicular to the drawing) of an effective heat generating portion of the heater 21 are larger than a maximum sheet passing width of the fixing apparatus.

The fixing roller 30 during rotation is heated by the heater 21 from the outside thereof in the heating contact region Nh, and supplies necessary and sufficient heat for fixing an unfixed toner image T on the recording material P in the fixing nip portion Nt.

As described above, if the toner image T is formed in an image forming portion, the recording material P is fed to the fixing apparatus 7, is introduced into the fixing nip portion Nt formed between the fixing roller 30 and the pressure roller 63, and is pinched and conveyed in the fixing nip portion Nt. While the recording material P is pinched and conveyed in the fixing nip portion Nt, the recording material P is heated by the fixing roller 30, and undergoes a nip portion pressure. Accordingly, the unfixed toner image T is fixed on the surface of the recording material P with heat and pressure as a fixed image.

The heating contact region Nh and the fixing nip portion Nt are formed at different positions on the periphery of the fixing roller 30. Short distances of the heating contact region Nh and the fixing nip portion Nt on the periphery of the fixing roller in the rotation direction of the fixing roller do not let much of the heat dissipation to the air and the heat escape to the inside of the fixing roller. Therefore, heat can be efficiently transferred from the heating contact region Nh to the fixing nip portion Nt.

As shown in FIG. 1, if the fixing nip portion Nt and the heating contact region Nh are located to face to be shifted from each other by 180° as half of the peripheral length of the fixing roller, a pressure force of the heater 21 exerted on the fixing roller 30 and a pressure force of the pressure roller 63 exerted on the fixing roller 30 cancel out each other. For this reason, flexure of the fixing roller 30 can be minimized, and the strength needed for the core metal becomes small. Therefore, small diameter and small heat capacity can be easily realized.

If the fixing roller 30 has a small diameter, with the result that, the distances of the heating contact region Nh and the fixing nip portion Nt can be reduced. For this reason, when a significant difference in the pressure force of the heater 21 and the pressure roller 63 on the fixing roller 30 is not needed, as shown in FIG. 1, the fixing nip portion Nt and the heating contact region Nh may be arranged to face each other.

(3) Fixing Roller (Rotatable Heating Member) 30

Figure 3:
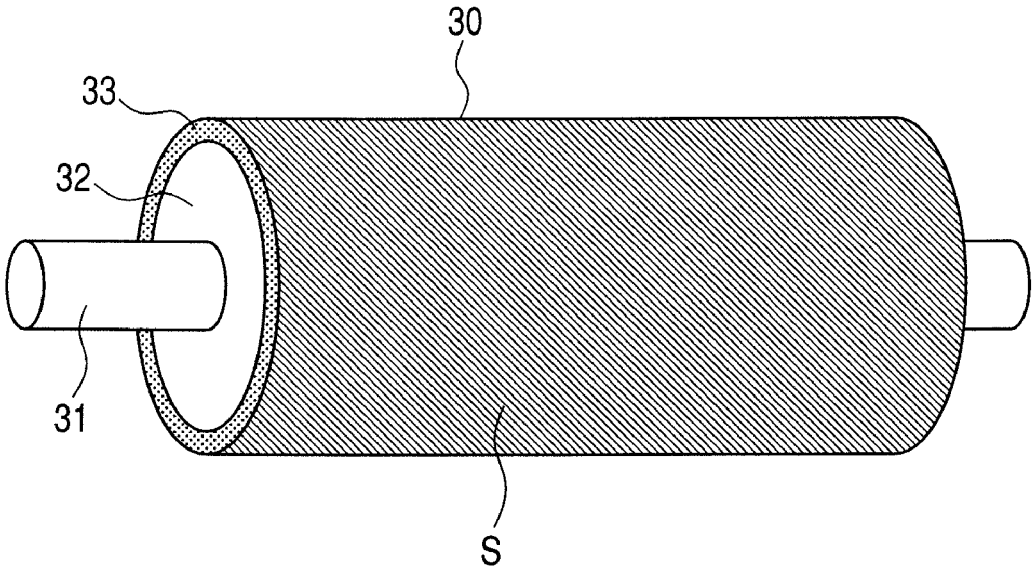
FIG. 3 is a schematic view of a fixing roller according to the first embodiment.

FIG. 3 is a schematic view of the fixing roller 30 according to this embodiment. The fixing roller 30 has a core metal 31, a first layer 32 formed at an outer periphery of the core metal 31, and a second layer 33 formed outside the first layer 32. The first layer 32 is an inside layer with respect to the second layer 33, and the second layer 33 is an outside layer with respect to the first layer 32.

The first layer 32 is a low thermal conductive elastic layer, is of lower thermal conductivity than the second layer 33, and has elasticity. Hereinafter, the first layer 32 is referred to as 'heat insulating elastic layer'.

The second layer 33 is a heat storage layer. A heat capacity per unit surface area of the fixing roller 30 serving as a heating member is in a range of 100 J/(m$^2$·K) to 600 J/(m$^2$·K). Hereinafter, the second layer 33 is referred to as 'heat storage layer'.

The core metal 31 is made of, for example, a metallic material, such as aluminum, iron, or an SUM material, or a rigid material, such as ceramic. The core metal 31 is heat-insulated from the surface of the fixing roller by the heat insulating elastic layer 32. Accordingly, even if the core metal 31 has lower thermal conductivity and lower heat capacity than the heat storage layer 33, it is of little effect. Therefore, the core metal 31 may have higher thermal conductivity and higher heat capacity than the heat storage layer 33. The core metal 31 may have a hollow cylindrical shape or a solid cylindrical shape.

As described above, the fixing roller (rotatable heating member) 30 has the heat insulating elastic layer 32 and the heat storage layer 33, which is provided outside the elastic layer and has at least one layer. A thermal conductivity of the heat insulating elastic layer 32 may be not more than 0.20 W/(m·k).

The heat storage layer 33 is made of, for example, high thermal conductive silicon rubber. The total heat capacity per unit surface area of the fixing roller is adjusted to be in a range of 100 J/(m$^2$·K) to 600 J/(m$^2$·K).

The heat capacity per unit surface area of the fixing roller means a value (C/S) obtained by dividing a heat capacity C of the heat storage layer 33 by a surface area S of the outer peripheral surface of the fixing roller. When the surface temperature of the fixing roller is maintained at a predetermined temperature, the heat capacity has connection with a heat storage amount per unit surface area of the fixing roller.

A relationship between 'the heat capacity C/S per unit surface area of the heat storage layer 33' and 'a time period t for which the fixing roller 30 is in contact with the recording material per rotation of the fixing roller 30 when the recording material P passes through the fixing nib portion Nt (that is, a time period t needed for one portion of the surface of the fixing roller (heating member) to pass through the fixing nip portion)' is expressed by the following expression.

$$C/S[\mathrm{J/(m^2 \cdot K)}] \leqq 10000[\mathrm{J/(s \cdot m^2 \cdot K)}] \times t[s]$$

When the time period t for which the recording material P and the fixing roller 30 are in contact with each other is short, a significant difference in the temperature between the fixing roller 30 and the recording material P is required in order to transfer heat to the recording material P within short time period. When the temperature of the fixing roller is inevitably increased, it is necessary to make the heat capacity of the heat storage layer 33 small.

The characteristic regarding the heat capacity will be described below based on the experiment result.

A volume heat capacity of the heat storage layer 33 (a volume heat capacity of the second layer) may be larger than a volume heat capacity of the heat insulating elastic layer 32 (a volume heat capacity of the first layer). The volume heat capacity of the heat storage layer 33 may be larger than that of solid rubber, for example, not less than $1.25\times10^6$ J/(m$^3$·K). If the heat capacity of the heat storage layer 33 is larger than that of the inside heat insulating elastic layer 32, heat stored in the fixing roller 30 is unevenly distributed in the heat storage layer 33 near the surface of the fixing roller 30, thereby easily performing heat transfer to the recording material P.

The thermal conductivity of the heat storage layer 33 may be higher than that of the heat insulating elastic layer 32. The thermal conductivity of the heat storage layer 33 is higher than that of solid rubber, for example, not less than 0.3 W/(m·K).

If the thermal conductivity of the inside heat insulating elastic layer 32 is lower than the thermal conductivity of the heat storage layer 33, heat transferred from the surface of the fixing roller is unevenly distributed and easily stored in the heat storage layer 33 near the surface of the fixing roller. In addition, if the thermal conductivity of the heat storage layer 33 is higher than that of the heat insulating elastic layer 32, heat absorption and dissipation in the heat storage layer 33 can be quickly performed.

The thermal conductivity, the volume heat capacity, and the heat capacity per unit surface area of the heat storage layer 33 are measured by the following method.

Figure 4:
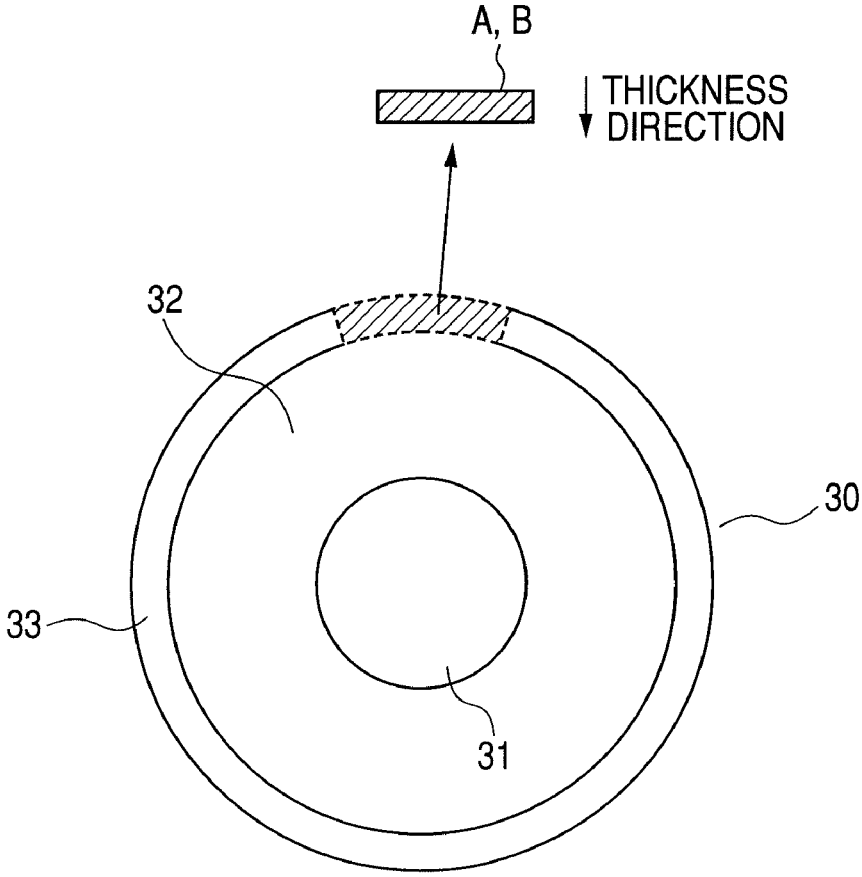
FIG. 4 is a schematic view illustrating a method of measuring thermal conductivity of layers forming a fixing roller.

That is, as shown in FIG. 4, a test piece A of vertical 5 mm and horizontal 5 mm is cut out from the heat storage layer 33 of the fixing roller 30.

A mass density is obtained by measuring the test piece A with a dry densitometer (Model No.: AccuPyc 1330, manufactured by Shimadzu Corporation).

Specific heat is obtained by measuring the test piece A with a differential scanning calorimeter (Model No.: DSC8240, manufactured by Rigaku Corporation).

The heat capacity and the heat capacity per unit surface area of the fixing roller are obtained by the following expressions.

$$\text{Volume heat capacity}=\text{Mass density}\times\text{Specific heat capacity} \quad 1)$$

$$\text{Heat capacity per unit surface area of fixing roller}=\text{Volume of test piece A}\times\text{volume heat capacity}+\text{Surface area of test piece A or }=\text{Volume heat capacity}\times\text{Specific heat capacity}\times\text{Thickness of heat storage layer} \quad 2)$$

The thermal conductivity is obtained by measuring a thermal diffusivity in the thickness direction with a Fourier transform type temperature thermal diffusivity measurement instrument (Model No.: FTC-1, manufactured by Ulvac Riko Inc) for the test piece A. Then, the thermal conductivity of the heat storage layer 33 in the thickness direction is obtained.

$$\text{Thermal conductivity}=\text{Thermal diffusivity}\times\text{Mass density}\times\text{Specific heat capacity} \quad 3)$$

The heat storage layer 33 is formed by the following method. For example, a layer obtained by blending 10% by mass to 50% by mass of powdery filler into a rubber material, such as silicon rubber or fluorine-containing rubber, is formed on the heat insulating elastic layer 32, thereby forming a solid rubber layer.

The blending of not less than 10% by mass of the filler results in higher heat capacity than usual solid rubber. In addition, if the amount of the filler to be blended is large, the heat storage layer 33 becomes hardened, and thus the surface of the fixing roller 30 becomes hardened. If the blending amount is less than 50% by mass, the surface of the fixing roller 30 can be rendered sufficient elasticity.

The powdery filler contains a material having a volume heat capacity of not less than $1.25\times10^6$ J/(m$^3$·K) (filler having a high volume heat capacity) and a thermal conductivity of not less than 10 [W/(m·K)] (filler having high thermal conductivity).

As described above, if filler of high volume heat capacity is dispersed, the volume heat capacity of the heat storage layer 33 can be increased while the blending amount can be suppressed. Further, if filler of high thermal conductivity is dispersed, the thermal conductivity can be increased while the blending amount can be suppressed.

For example, the powdery filler may contain a metal oxide, such as AlN, graphite, or alumina, a metal, such as carbon nanotube, diamond, aluminum, titanium alloy, or copper alloy, boron nitride, silicon nitride, or crystalline silica.

Any filler material may be used insofar as desired heat capacity and thermal conductivity can be rendered. In addition, the filler may have any shape. Regardless of the filler material and the shape of the filler, the object of this embodiment can be accomplished.

The thickness of the heat storage layer 33 (the thickness of the second layer) may be in a range of 30 μm to 400 μm. The filler-dispersed high-heat capacity heat storage layer 33 has elasticity and a high degree of hardness. For this reason, if the heat storage layer 33 is excessively thick, the surface of the fixing roller also becomes hardened, and accordingly close-contactness to the recording material P becomes unsatisfactory. If the close-contactness to the recording material P becomes unsatisfactory, it is difficult to evenly fix the toner image. Therefore, the heat storage layer 33 may be not more than 400 μm. In addition, if the heat storage layer 33 is excessively thin, it is difficult to evenly disperse the filler and to obtain even heat capacity and thermal conductivity, which causes fixing irregularity. Therefore, the heat storage layer 33 may be thin not less than 30 μm.

The heat insulating elastic layer 32 is a low thermal conductive rubber layer, and the thermal conductivity thereof is adjusted to be lower than that of the heat storage layer 33. As described above, the thermal conductivity of the heat insulating elastic layer 32 may be not more than 0.20 W/(m·k).

The thermal conductivity and volume heat capacity of the heat insulating elastic layer 32 are measured by the following method. As shown in FIG. 4, a test piece B of thickness 500 μm, vertical 5 mm, and horizontal 5 mm is cut out from the heat insulating elastic layer 32 of the fixing roller 30. By the same method as that in the test piece A of the heat storage layer 33, the thermal conductivity and volume heat capacity in the thickness direction are obtained.

The thickness of the heat insulating elastic layer 32 formed at the outer periphery of the core metal 31 is not particularly limited. In order to render effective heat insulation performance, to prevent the heat capacity from being excessively increased, and to construct the fixing roller 30 of a small diameter, the thickness of the heat insulating elastic layer 32 may be in a range of 1.0 to 5.0 mm, and particularly, 2.0 to 4.0 mm.

In this embodiment, the outside heating type fixing apparatus 7 is not provided with inner parts, such as a heat source, in the fixing roller, thereby reducing the outer diameter of the fixing roller 30, unlike the known inside heating type fixing apparatus.

The heater 21 serving as a heating unit and the pressure roller 63 serving as a pressure member are adapted to come into contact with the fixing roller 30 in the horizontal direction, and the pressures of the heater 21 and the pressure roller 63 against the fixing roller 30 are set to be identical to each other. In this way, the pressures against the fixing roller 30 cancel out each other. Therefore, even if the fixing roller 30 is of a small diameter, there is no case in which the fixing roller 30 is flexed due to lacking in strength.

The fixing roller 30 may be of a small diameter and rendered small heat capacity. Further, the fixing roller 30 may be of an outer diameter ranging from 10 to 20 mm.

The heat insulating elastic layer 32 is formed by, for example, the following method. A compound obtained by blending hollow filler into an organo polysiloxane composition, or a compound obtained by blending water-absorbing polymer and water into an organo polysiloxane composition is formed and then burned and hardened, thereby forming the heat insulating elastic layer 32.

For example, a silicon rubber composition obtained by blending 0.1 to 200% by mass of hollow filler having an average particle size of 500 μm into 100 parts by weight of a thermosetting organo polysiloxane composition is heated and hardened, thereby forming a balloon rubber layer.

The hollow filler contains gas components in a hardened material and is used to reduce thermal conductivity, like sponge rubber. For example, a micro balloon material may be used. The micro balloon material may include glass balloon, silica balloon, carbon balloon, phenol balloon, acrylonitrile balloon, vinylidene chloride balloon, alumina balloon, zirconia balloon, and Shirasu balloon.

The blending amount of the hollow filler is in a range of 0.1 to 200 parts by weight, particularly, 0.2 to 150 parts by weight, and more particularly, 0.5 to 100 parts by weight with respect to 100 parts by weight of the thermosetting organo polysiloxane composition 100. In this case, the content of the hollow filler in the silicon rubber composition for the fixing roller may be in a range of 10 to 80% in a volume ratio and particularly 15 to 75%. If the volume ratio is excessively small, the thermal conductivity is insufficiently reduced. Further, if the volume ratio is excessively large, it is difficult to perform molding and blending, a molded part may be fragile with no elasticity.

The silicon rubber heat insulating layer 32 may be formed by, for example, adding water-absorbing polymer and water.

As such a silicon rubber composition, a composition obtained by adding, to 100 parts by weight of an organo polysiloxane composition, 0.1 to 50 parts by weight of water-absorbing polymer, 10 to 200 parts by weight of water, and a hardening catalyst, such as a platinum compound catalyst, and a cross-linking agent, such as SiH polymer may be used. Thereafter, the composition may be heated and molded, thereby forming the heat insulating elastic layer 32.

In this case, the composition is heated by three steps or two steps described below. In the first step, silicon-based polymer is not substantially hardened, and is molded by heating for 10 to 30 hours at a temperature less than 100° C., at which moisture is not evaporated, particularly, at a temperature of 50 to 80° C. Next, in the second step, the molded part is heated for 1 to 5 hours at a temperature of 120 to 250° C., particularly, 120 to 180° C., so as to evaporate water and moisture in water-containing impurities. The heating condition when moisture is evaporated may be configured to transform foams to a continuous foam structure or not. If the hardening speed is high, the foams are not transformed to the continuous foam structure, and many separate foams exist. If a control is performed such that hardening by cross-linking does not substantially occur, the foams are transformed to the continuous foam structure. Finally, in the third step, the obtained foam is heated for 2 to 8 hours at 180 to 300° C., and particularly, 200 to 250° C., so as to promote hardening, thereby completing a silicon rubber layer made of desired porous rubber-shaped foam.

A sponge-shaped silicon rubber layer formed by foaming silicon rubber may be used in this embodiment. The foamed silicon rubber may be formed by adding a thermal decomposition type foaming agent or by molding a foam with by-product hydrogen during hardening as a foaming agent.

However, in case of molding, in which rubber is foamed in a metallic mold, such as injection molding, it is difficult to obtain foamed silicon rubber having fine and even cells. Further, a cell diameter in the foamed silicon rubber is prone to be unevenly molded, and a wall thickness of the cell is also uneven, which leads to a significant variation in the strength.

From this viewpoint, when the fixing roller 30 of a small diameter is formed, if tension is successively applied to the fixing roller with small curvature radius, a weak cell wall is destroyed and defoamed. Further, the foamed silicon rubber is difficult to accomplish durability and heat insulation performance simultaneously. That is, in the foamed silicon rubber having uneven foam diameter, if a foaming magnification is increased so as to improve heat insulation performance, the cell wall forming the elastic layer further becomes thin, more foams are easily generated due to duration.

A solid rubber layer made of silicon rubber may be used in this embodiment. If the blending amount of a high thermal conductive composition, such as reinforcing filler, with respect to the silicon rubber extremely becomes small, low thermal conductivity of not more than 0.20 W/(m·K) can be accomplished.

However, the low thermal conductive solid rubber shows large thermal expansion. When the solid rubber is used for the fixing roller 30 which is directly heated by the heater 21, the outer diameter thereof considerably changes due to the thermal expansion. Further, when such a fixing roller is used for the fixing apparatus in the image forming apparatus, the conveying speed of the recording material P is changed, and it is difficult to maintain printing accuracy of an image on the recording material.

Accordingly, the heat insulating elastic layer 32 may be made of a liquid silicon composition based on organo polysiloxane containing balloon, such as microballon, or water-absorbing polymer. Even open cells are obtained. For this reason, the heat insulating elastic layer 32 has excellent heat insulation performance and durability and shows small thermal expansion, as compared with a sponge silicon rubber heat insulating layer or a solid rubber heat insulating layer.

A manufacturing process of the fixing roller 30 is not particularly limited. The heat insulating elastic layer 32 is formed on the core metal 31, and then the heat storage layer 33 having thermal conductivity higher than that of the heat insulating elastic layer 32 is formed as an uppermost layer. Further, any manufacturing process may be used insofar as the heat capacity of the heat storage layer 33 per unit surface area of the fixing roller is in a range of 100 $J/m^2 \cdot K$ to 600 $J/m^2 \cdot K$.

(4) Construction Other than Fixing Roller (4-1) Heater 21

Figure 5:
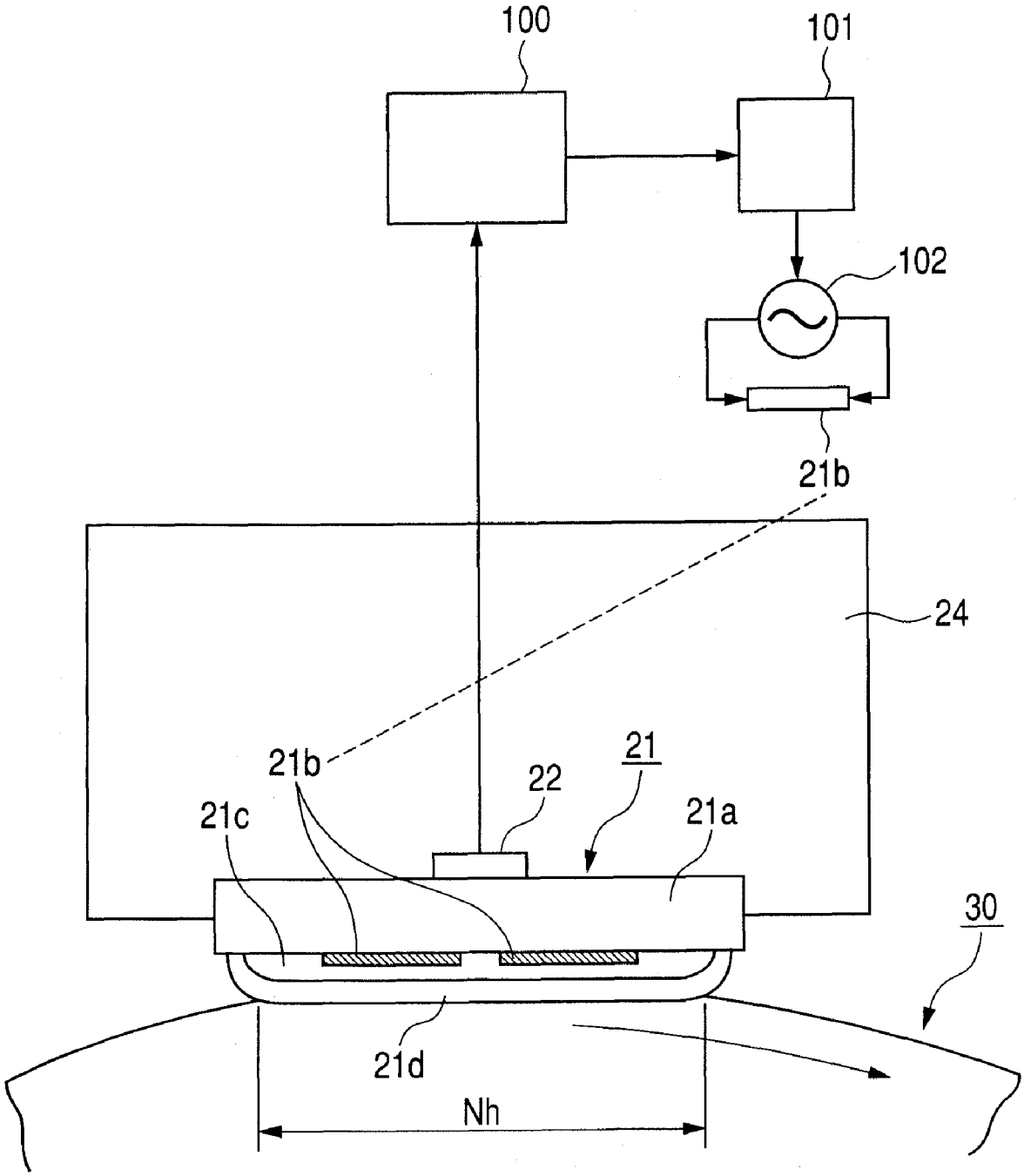
FIG. 5 is a schematic cross-sectional view of a plate-shaped heater.

FIG. 5 is a schematic cross-sectional view of the heater 21. A heater substrate 21*a* is a heat-insulating and electrical-insulating member made of insulating ceramic, such as alumina or aluminum nitride, or heat-insulating resin, such as polyimide, PPS, or liquid crystal polymer. The substrate 21*a* is a long and thin member in a longitudinal direction, for example, a direction perpendicular to the drawing, and has a length larger than the maximum sheet passing width of the fixing apparatus.

An electrical energization heat generating resistant layer 21*b* made of Ag/Pd (silver-palladium), $RuO_2$, or $Ta_2N$ is formed on a surface of the substrate 21*a* (a surface facing the fixing roller) in the longitudinal direction by screen printing and coating. The electrical energization heat generating resistant layer 21*b* is formed in the shape of a line or a thin band having a thickness of approximately 10 μm and a width of approximately 1 mm to 5 mm.

An insulating protective layer 21*c* made of glass or polyimide (PI) resin is formed on the electrical energization heat generating resistant layer 21*b* to protect and insulate the electrical energization heat generating resistant layer 21*b*. The insulating protective layer is formed to have a thickness of approximately 10 μm to 100 μm.

A slide layer 21*d* made of a material, such as fluorine resin, having satisfactory slidability and releasability is formed to improve slidability against the fixing roller 30 and prevent toner from sticking. The slide layer 21*d* is formed to have a thickness of approximately 10 μm to 30 μm.

Alternatively, a protective layer made of fluorine resin may be formed directly on the electrical energization heat generating resistant layer 21*b* to have a thickness of approximately 10 μm to 100 μm. In this case, the protective layer may function as the insulating protective layer and the slide layer.

The insulating protective layer 21*c*, the slide layer 21*d*, and the layer functioning as both layers are formed as thin as possible such an extent that durability, planarization, and releasability can be secured. Further, while releasability is maintained, a high thermal conductive filler may be mixed to improve thermal conductivity.

The heater holder 24 that fixedly holds the heater 21 is made of heat insulating resin, such as liquid crystal polymer, phenol resin, PPS, or PEEK. The lower thermal conductivity is, the higher thermal efficiency when the fixing roller 30 is heated is. Accordingly, a hollow filler, for example, glass balloon or silica balloon may be contained in the resin layer.

A temperature detecting unit 22, such as a thermistor, is arranged on a side of the heater 21 opposite to the fixing roller 30. The temperature detecting unit 22 detects a temperature of the substrate 21*a* that is elevated according to heat generation of the electrical energization heat generating resistant layer 21*b*. The temperature detecting unit 22 is provided to control the heater 21 in temperature.

The temperature control is performed by appropriately controlling a duty ratio or a wave number of a voltage to be applied to the electrical energization heat generating resistant layer 21*b* from an electrode portion (not shown) at a longitudinal end of the heater 21 according to a signal from the temperature detecting unit 22 to thereby cause heat generation of the heater 21. The width of an effective heat generating region along the longitudinal direction of the heater 21 is larger than the maximum sheet passing width of the fixing apparatus. Detection temperature information from the temperature detecting unit 22 is sent to a triac element 101 serving as a conducting driver through a temperature control portion 100. The triac element 101 turns on/off an AC power supply 102, which supplies power to the electrical energization heat generating resistant layer 21*b*, based on a conduction signal from the temperature control portion 100.

The temperature control may be performed by setting the temperature of the heater 21 at a given temperature or by coming into contact with the surface of the fixing roller and setting the surface temperature of the fixing roller at a given temperature to thereby power control to the heater 21.

If the temperature control is performed such that the surface temperature of the fixing roller is set to a given temperature, fixability can be evenly maintained, and a defective image, such as hot offset, due to excessive heat transfer, can be prevented.

A temperature at which silicon rubber or fluorine resin for the fixing roller 30, the heater 21, and peripheral parts is successively available is usually 230° C. and particularly, approximately 200° C. If silicon rubber or fluorine resin is used at a higher temperature, silicon rubber may be deteriorated, or wear resistance of fluorine resin may become unsatisfactory.

The surface temperature of the fixing roller and the temperature of the heater 21 may be controlled to not more than 230° C., and particularly, approximately 200 to 230° C.

Figure 6:
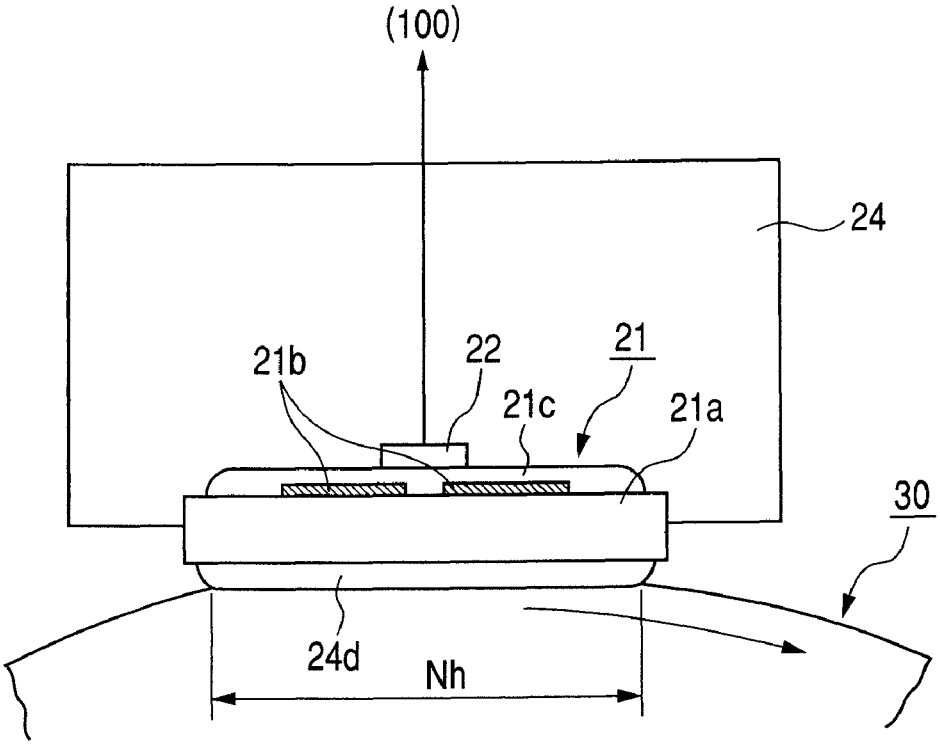
FIG. 6 is a schematic cross-sectional view of a plate-shaped heater different in structure from the plate-shaped heater shown in the preceding drawings.

In the above description, the heater 21 in which the electrical energization heat generating resistant layer 21*b* is formed on a side of the substrate 21*a* facing the fixing roller has been described. Alternatively, when aluminum nitride having satisfactory thermal conductivity is used for the heater substrate 21*a*, as shown in FIG. 6, the heater 21 may be a backside (bottom side) heating type. Specifically, the electrical energization heat generating resistant layer 21*b* is formed on the back surface of the substrate 21*a* (a surface opposite to the surface facing the fixing roller), and the insulating protective layer 21*c* is provided on the electrical energization heat generating resistant layer 21*b* serving as a heat generating member. Further, the slide layer 21*d* may be provided on the surface of the substrate 21*a* (the surface facing the fixing roller).

Figure 7:
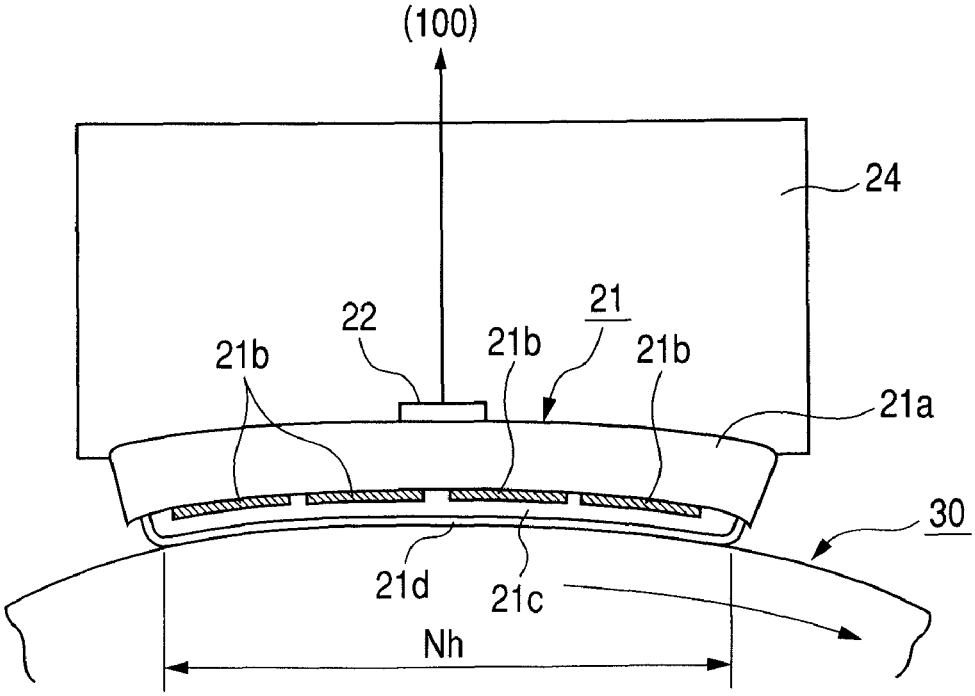
FIG. 7 is a schematic cross-sectional view of a plate-shaped heater different in structure from the plate-shaped heater shown in the preceding drawings.

As shown in FIG. 7, the surface of the substrate 21*a* facing the fixing roller in the heater 21 may be curved corresponding to an outer surface of the fixing roller 30. The heater 21 can easily follow the surface of the fixing roller, and a wide fixing nip portion Nt can be secured along the rotation direction of the fixing roller 30 with less pressure force.

Figure 8:
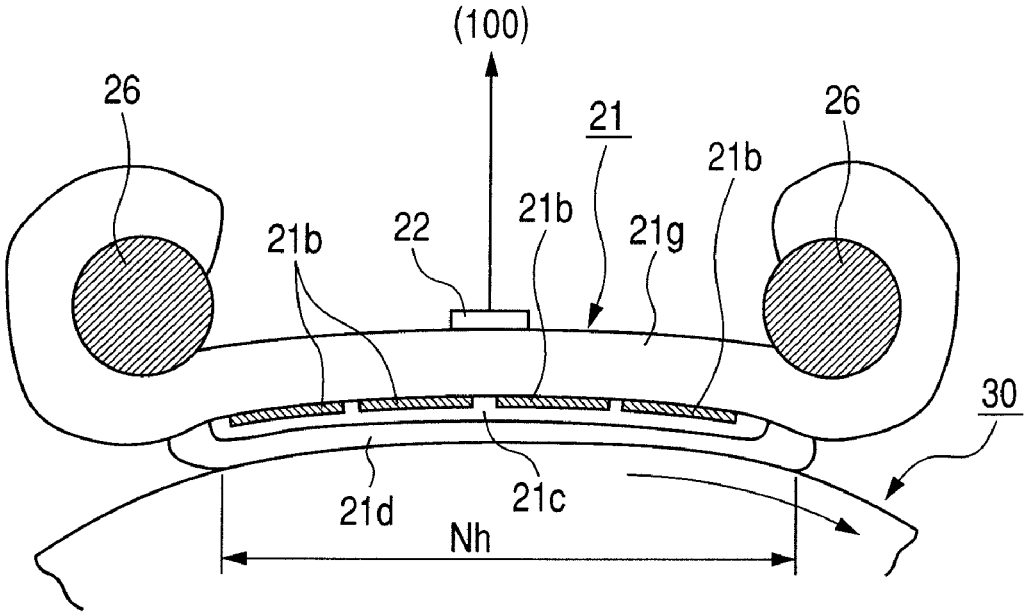
FIG. 8 is a schematic cross-sectional view of a plate-shaped heater different in structure from the plate-shaped heater shown in the preceding drawings.

As shown in FIG. 8, a heater 21 may have flexibility. For example, heat insulating resin made of polyimide or polyamide-imide is formed in the shape of a sheet having a thickness of 50 μm to 300 μm, thereby forming a heat generating and insulating heater substrate 21*g* having flexibility. An electrical energization heat generating resistant layer 21*b* made of, for example, an SUS thin film is formed on the heater substrate 21*g*. An insulating protective layer 21*c* made of polyimide (PI) resin is formed to have a thickness of approximately 10 μm to 100 μm. Further, the slide layer 21*d* made of fluorine resin is formed to have a thickness of approximately 10 μm to 30 μm. In this way, the sheet-shaped heater 21 having flexibility all over is completed.

The heater 21 is supported by fixing upstream and downstream ends in the rotation direction of the fixing roller to supports 26, and is pressed into contact with the surface of the fixing roller 30. The sheet-shaped heater 21 has flexibility. Therefore, the sheet-shaped heater 21 can easily follow the surface of the fixing roller 30, and a wide fixing nip portion Nt can be secured along the rotation direction of the fixing roller 30 with less pressure force.

Figure 9:
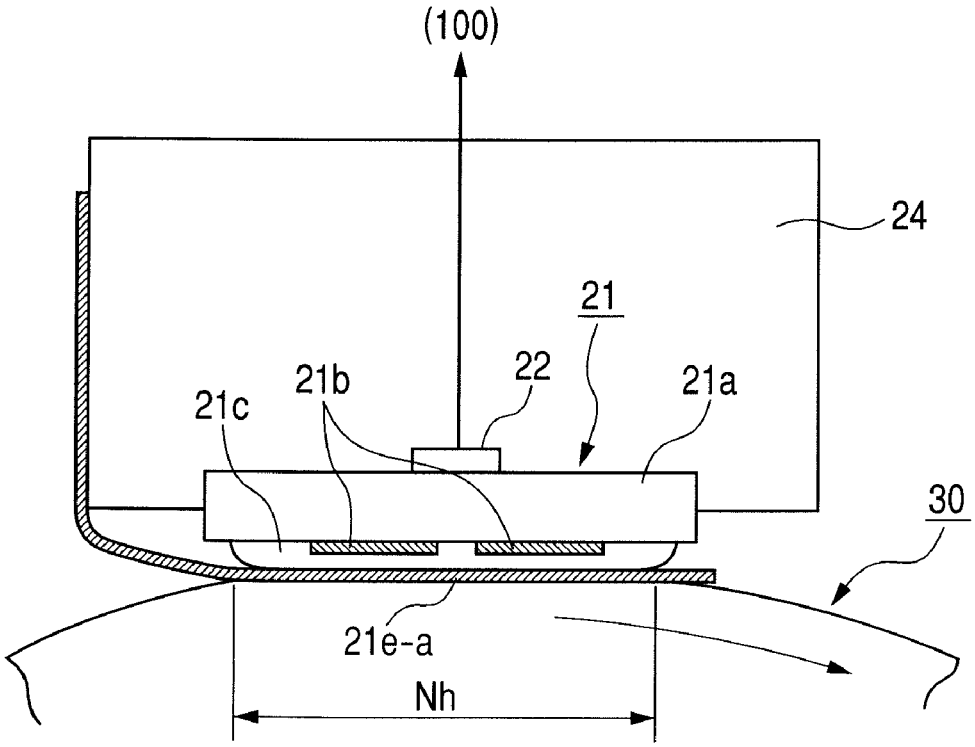
FIG. 9 is a schematic cross-sectional view of a plate-shaped heater different in structure from the plate-shaped heater shown in the preceding drawings.

Instead of the slide layer 21*d* of the heater 21, as shown in FIG. 9, a protective sheet 21*e-a* may be disposed on a side of the heater 21 facing the fixing roller (surface side), thereby forming a fixing nip portion Nt between the heater 21 and the fixing roller 30.

The protective sheet 21*e-a* includes, for example, a sheet base layer and a release layer made of fluorine resin formed on a surface of the sheet base layer facing the fixing roller to have a thickness of 10 μm to 30 μm. The sheet base layer is a metallic member made of, for example, stainless steel (SUS), nickel (Ni), titanium (Ti), or copper (Cu). Alternatively, a sheet having a thickness of 30 to 100 μm formed by mixing a high thermal conductive filler containing metallic particles or powder of metal oxide, artificial diamond, or graphite with a large amount in a heat insulating resin, such as polyimide (PI), may be used. Further, the protective sheet 21*e-a* may be formed of in the shape of a sheet having a thickness of 30 μm to 100 μm by using a fluorine resin simplex.

(4-2) Pressure Roller (Nip Forming Member) 63

In this embodiment, the pressure roller 63 includes an elastic layer 42 outside a core metal 41 made of aluminum, iron, or an SUM material, and a release layer 43 as an uppermost layer.

The pressure roller 63 comes into contact with and presses the fixing roller 30 to form the fixing nip portion Nt. In the fixing nip portion Nt, a flow of heat from the surface of the fixing roller 30 to the pressure roller 63 is suppressed as much as possible, while a rising speed of the surface temperature of the fixing roller 30 in the heating contact region Nh becomes high.

Accordingly, similarly to the heat insulating elastic layer 32 of the fixing roller 30, as the elastic layer 42, a balloon rubber layer is used in which a hollow filer, such as microballoon, is blended into silicon rubber. Alternatively, a silicon rubber layer containing water-absorbing polymer or a sponge rubber layer formed by foaming silicon rubber with hydrogen may be used. In addition, a solid rubber layer having low thermal conductivity may be used.

The release layer 43 is made of, for example, polytetrafluoroethylene (PTFE) resin, tetrafluoroethylene-perfluoroalkylvinyl ether copolymer (PFA) resin, or fluoroethylene-polypropylene copolymer (FEP) resin. Further, polyvinylidene fluoride (PVDF) resin or polyvinyl fluoride (PVF) resin may be used.

Coating may be formed of latex or Daiel (Trademark, manufactured by Daikin Industries, Ltd., fluorinated latex) by dip coating with dispension, or spray coating. Unlike the uppermost layer of the fixing roller 30, the elastic layer 42 and the release layer 43 may have low thermal conductivity, and may not be mixed with a high thermal conductive filler.

Figure 10:
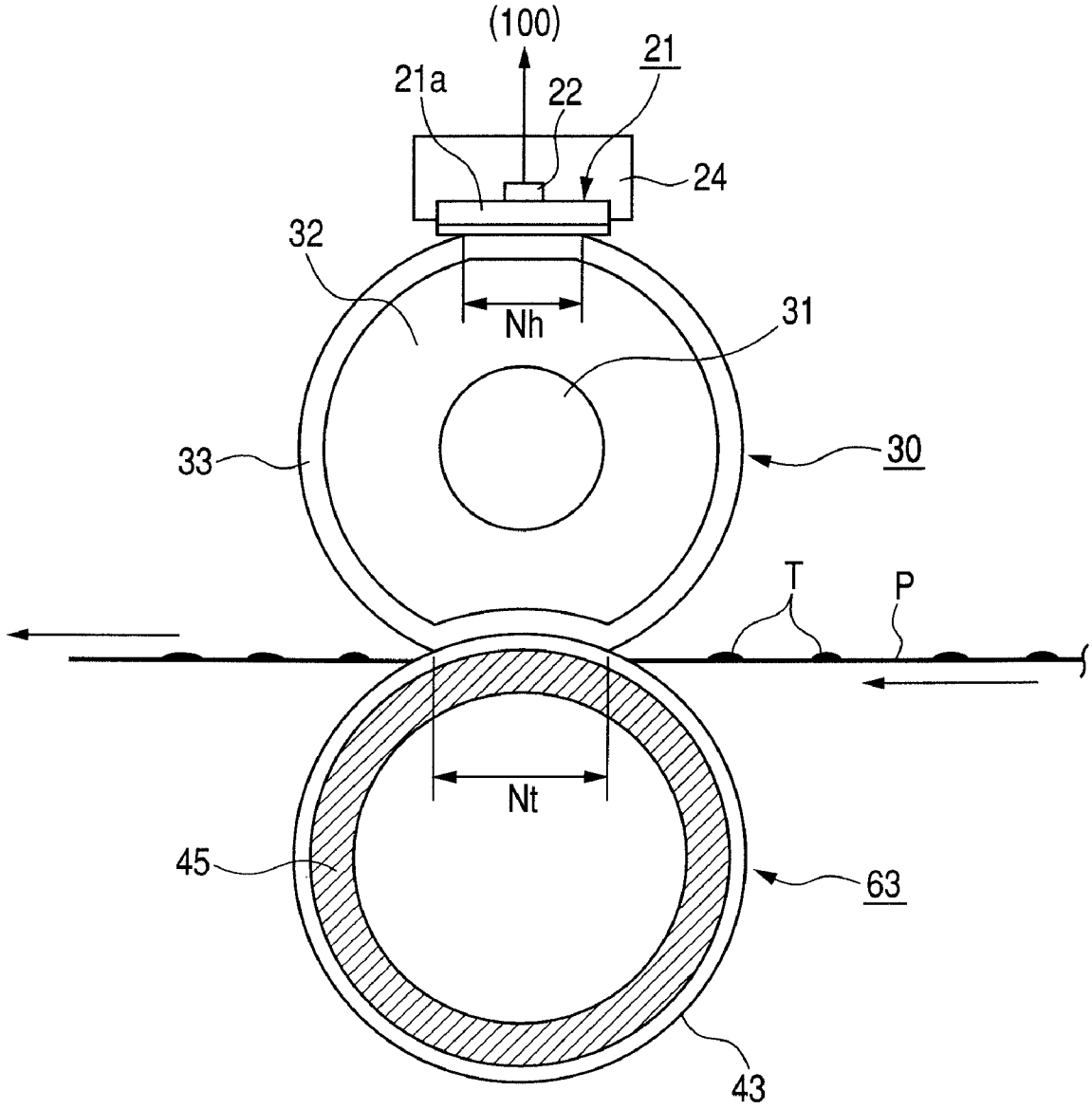
FIG. 10 is a schematic cross-sectional view of a fixing apparatus different in structure from the fixing apparatus shown in the preceding drawings.

As shown in FIG. 10, the pressure roller 63 may be a rigid cylindrical member in which a release layer 43 is formed directly outside a core metal 45. Since the fixing roller 30 is provided with the elastic layer, even if the pressure roller 63 is not an elastic member, the fixing nip portion Nt can be formed. Since the heat insulating elastic layer is not provided between the core metal 45 and the release layer 43, heat insulation performance is lacking, and heat of the fixing roller 30 is easily escaped to the pressure roller 63. Therefore, the core metal 45 may be a hollow core metal, not a solid core metal, so as to reduce the heat capacity.

(5) Driving Description

With the above-described construction, in a state where the fixing roller 30 is rotated, and the pressure roller 63 is rotated by the rotation of the fixing roller 30, electrical energization of the heater 21 is started. Then, the surface temperature of the heater 21 and the fixing roller 30 is increased to a temperature for heating and fixing the recording material.

Since the heater 21 itself is of small heat capacity, the temperature rising speed is high.

The fixing roller 30 includes the heat insulating elastic layer 32 formed on the core metal 31, and has sufficient heat capacity only near the surface thereof. Further, the inside heat insulating elastic layer 32 has small heat capacity. The heat storage layer 33 of high thermal conductivity is formed on the surface of the fixing roller 30. Therefore, heat can be efficiently transferred from the heater 21 to the heat storage layer 33 near the surface of the fixing roller. For this reason, the rising speed of the surface temperature of the fixing roller 30 is high.

In a state where the surface of the fixing roller surface is maintained at a given temperature, the recording material P on which the unfixed toner image T is formed is introduced into the fixing nip portion Nt. Then, the unfixed toner image T on the recording material P is heated and fixed to form a fixed image.

The heat storage layer 33 having high thermal conductivity and renders the surface of the fixing roller to have sufficient heat capacity is formed on the surface of the fixing roller 30. Accordingly, the toner image T on the recording material P can be heated and fixed with a sufficient heat amount.

Figure 11:
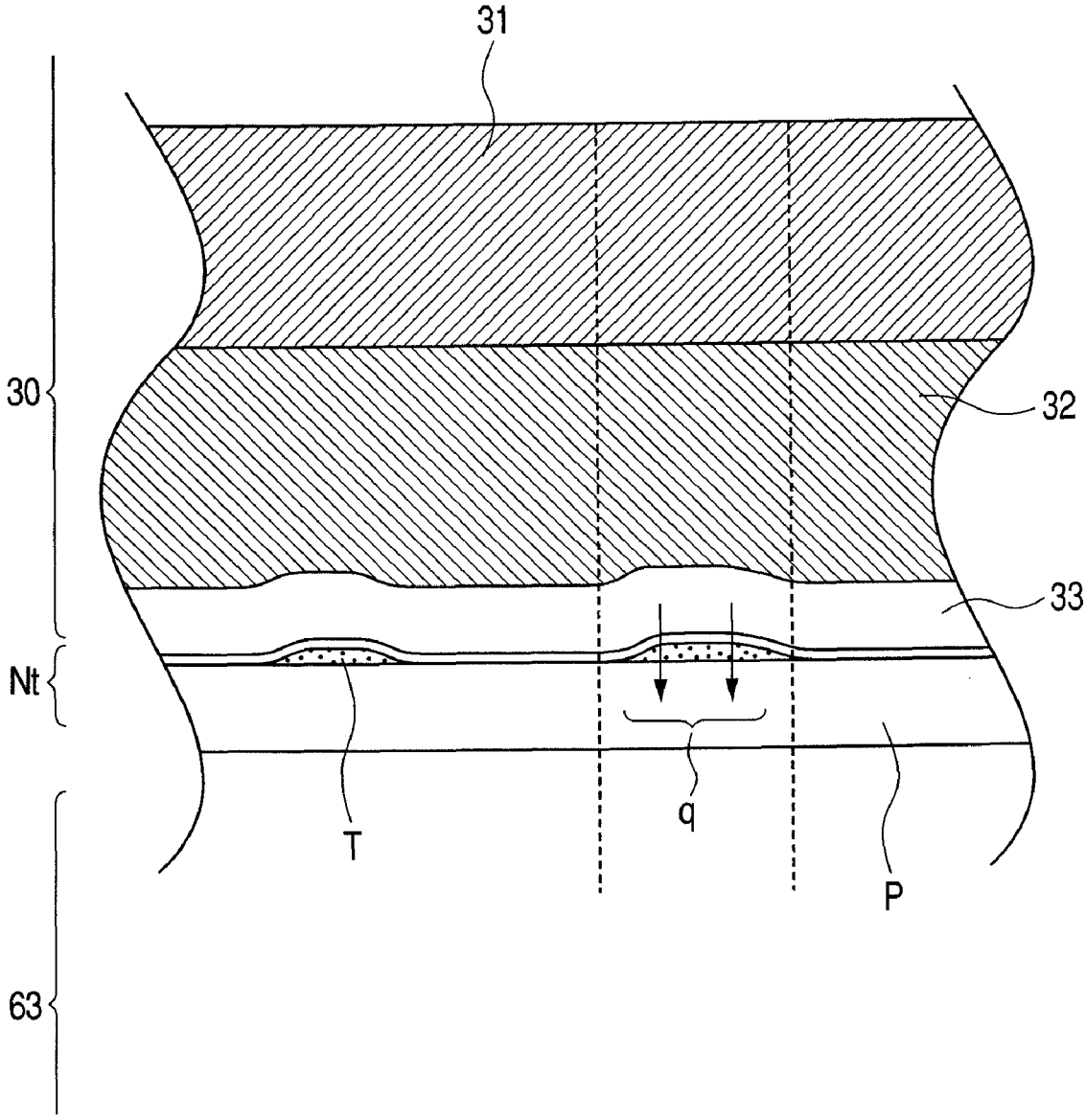
FIG. 11 is a schematic view illustrating a behavior in a fixing nib.

The dimensions of the toner image T in the fixing nip portion Nt and the fixing roller 30 will be described with reference to FIG. 11. Referring to FIG. 11, the recording material P on which the unfixed toner image T is formed is introduced into the fixing nip portion Nt, the toner image T is pressed by the surface of the fixing roller 30 and held in a compressed state. At this time period, since the fixing roller 30 has elasticity, the surface thereof is slightly deformed according to unevenness of the toner image T. As a result, the uppermost high thermal conductive layer 33 of the fixing roller 30 is recessed to cover the toner image T. As a result, the contact area of the fixing roller 30 is increased with respect to the toner image T, and thus heat can be efficiently transferred from the fixing roller 30 to the toner image T on the recording material P. Particularly, as illustrated in this embodiment, since the fixing roller 30 is an elastic member, even if the toner image on the recording material has considerable surface roughness, the surface of the fixing roller 30 has excellent followability with respect to the unevenness of the recording material P, thereby accomplishing even fixability on the recording material P.

Since the recording material follows the surface of the fixing roller, even if the surface of the fixing roller is slightly deformed, heat applied to the toner image per unit area on the recording material becomes heat q stored per unit surface area of the fixing roller 30 and an inside region thereof. That is, the heat storage amount q per unit surface area of the fixing roller acts as a main heat source for heating and fixing the toner image T per unit area. In the embodiment of the present invention, the heat storage layer of the fixing roller is formed to have a heat capacity per unit surface area of not less than 100 J/m$^2$·K, and a sufficient heat amount is stored in the heat storage layer of the fixing roller, thereby fixing the unfixed toner image T.

In this embodiment, the fixing apparatus 7 can obtain a satisfactory image with not fixing irregularity within a short first print-out time period. Since the warm-up time period is short, standby temperature adjustment is not performed. No useless power is consumed during a standby state, and thus power saving can be accomplished.

(6) Examples of Other Heating Units

In the foregoing description, a case where the plate-shaped heater 21 is used as a heating unit for heating the fixing roller 30 from the outside thereof has been described. In this case, the plate-shaped heater 21 is pressed contact with the surface of the fixing roller 30, and comes into contact with the fixing roller 30 during rotation while frictionizing therewith.

The heating unit for heating the fixing roller 30 from the outside thereof is not limited to the above-described construction. Any heating unit may be used insofar as it is of small heat capacity, and can rapidly increase the temperature and form the heating contact region Nh with the fixing roller 30 to heat the fixing roller.

Figure 12:
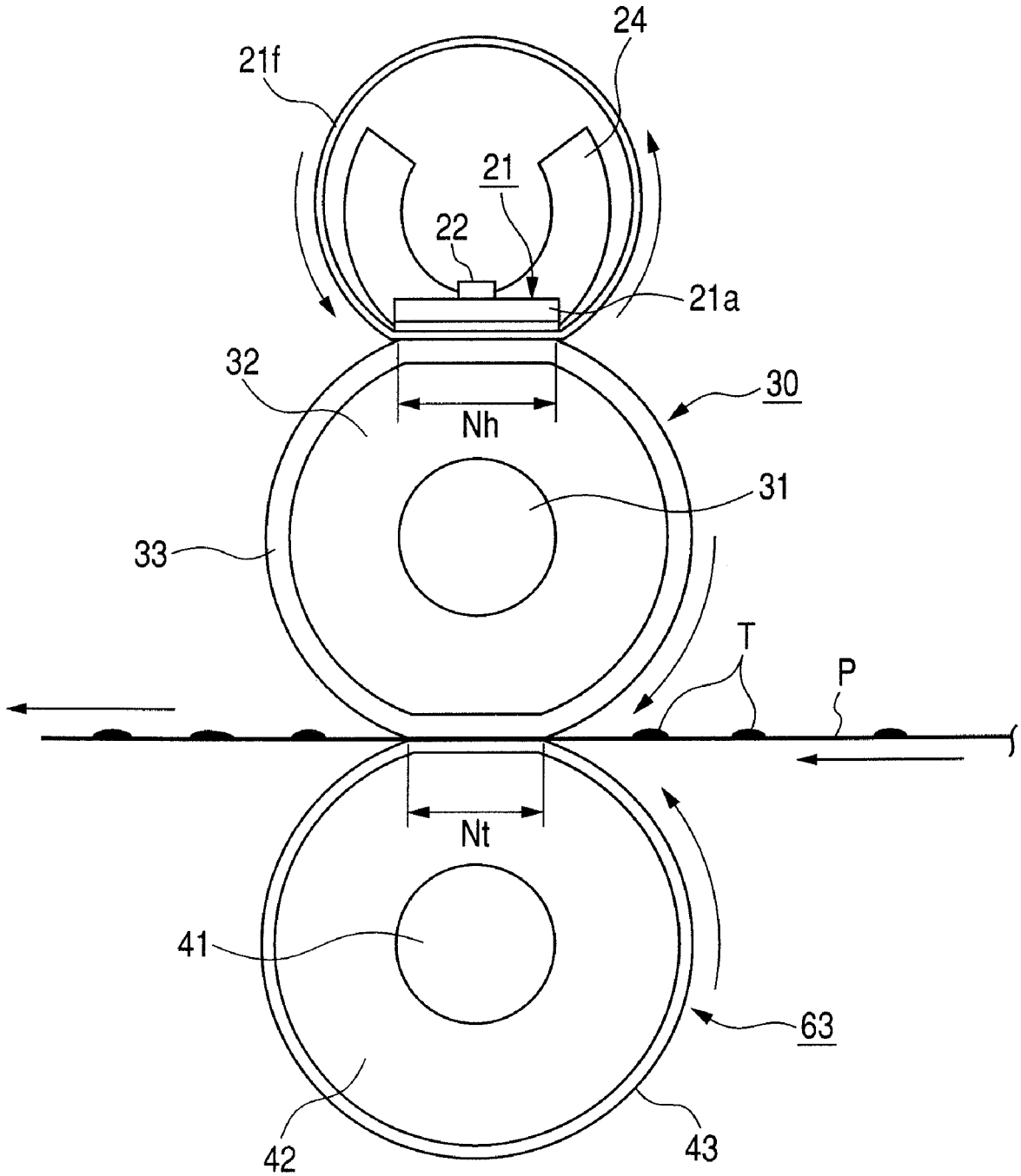
FIG. 12 is a schematic cross-sectional view of a fixing apparatus different in structure from the fixing apparatus shown in the preceding drawings.

For example, as shown in FIG. 12, a heating film 21*f* as a flexible member is slidably and rotatably engaged with the heater 21 outside the heater holder 24 supporting the heater 21. The heating film 21*f* may be disposed between the heater 21 and the fixing roller 30 to form the heating contact region Nh.

The heating film 21*f* is rotated around the heater holder 24 by the rotation of the fixing roller 30 while sliding onto the surface of the heater 21, thereby protecting the heater 21.

The heating film 21*f* is a film-shaped member adapted to include, for example, a sheet base layer and a release layer made of, for example, fluorine resin on a side the sheet base layer facing the fixing roller to have a thickness of 10 μm to 30 μm. The sheet base layer is a metallic member made of, for example, stainless steel (SUS), nickel (Ni), titanium (Ti), or copper (Cu). Alternatively, a sheet base layer having a thickness of 30 μm to 100 μm formed by mixing a high thermal conductive filler containing metallic particles or powder of metal oxide, artificial diamond, or graphite with a large amount in a heat insulating resin, such as polyimide (PI), may be used. Further, the heating film 21*f* may be formed of in the shape of a sheet having a thickness of 30 to 100 μm by using a fluorine resin simplex.

In order to minimize the heat capacity of the heating film 21*f* itself and to suppress heat dissipation to the air, an outer diameter of the heating film 21*f* may be of a small diameter, for example, approximately ϕ18 to ϕ10.

Figure 13:
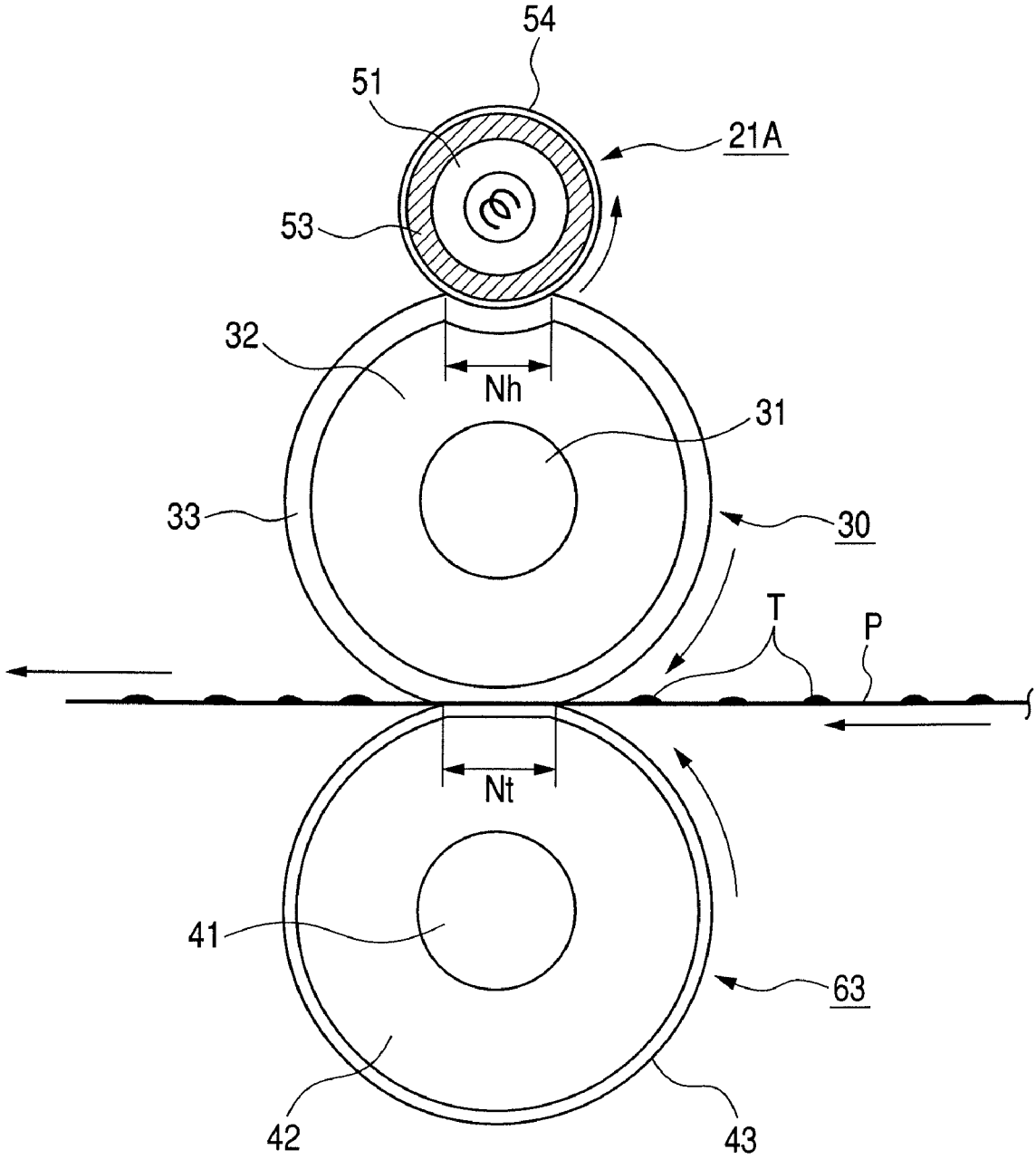
FIG. 13 is a schematic cross-sectional view of a fixing apparatus different in structure from the fixing apparatus shown in the preceding drawings.

As the heating unit for heating the fixing roller 30 from the outside thereof, as shown in FIG. 13, a heat roller 21A may be used. The heat roller 21A is provided with a heat source 51, such as a halogen heater, inside a hollow core metal 53.

The heat roller 21A may be of small heat capacity so as to accomplish a rapid increase in the temperature. For example, a cylindrical member of a small diameter may be used in which a release layer 54 made of, for example, fluorine resin is formed on the hollow core metal 53 having an outer diameter of approximately ϕ18 to ϕ10 and a thickness of 1 to 0.3 mm to have a thickness of 10 μm to 30 μm.

(7) Experiment and Confirmation

For confirmation of the foregoing description, experiments were carried out by using an image forming apparatus having the fixing apparatus 7 according to this embodiment.

First, the basic construction of the fixing apparatus 7 used in the experiment will be described below.

A process speed of the used image forming apparatus was 100 mm/sec, and the experiments were carried out by using a laser beam printer which prints 16 sheets of recording materials per minute.

In the fixing apparatus 7, as a heating unit for heating the fixing roller 30 from the outside thereof, a ceramic heater (plate-shaped heater) 21 in which a heat generating paste made of silver and palladium having a thickness of 10 μm is formed on a ceramic substrate 21*a* having a thickness of 1.0 mm was used. The ceramic heater 21 is held by a heat insulating liquid crystal polymer member (heater holder) 24 containing a hollow resin.

On the surface of the ceramic heater, an insulating glass layer 21*c* having a thickness of 30 μm is formed so as to protect a heat generating member, and a slide layer 21*d* made of a PFA resin having a thickness 10 μm is provided.

As the pressure roller 63, a pressure roller was used in which a silicon rubber layer 42 having a thermal conductivity of 0.12 W/(m·K) and a thickness of 2.0 mm is formed on an SUM core metal 41 having an outer diameter 8 mm, and a fluorine resin layer 43 is provided outside the silicon rubber layer 42.

With the above-described construction, a pressure force of 49 N was applied between the ceramic heater 21 and the fixing roller 30 to form the heating contact region Nh having a width of 7 mm. Further, a pressure force of 49 N was applied between the fixing roller 30 and the pressure roller 63 to form the fixing nip portion Nt having a width of 7 mm. The heater 21 and the pressure roller 63 face each other at an angle of 180° around the fixing roller 30.

Experiment 1

In the fixing roller 30 used in this experiment, a silicon rubber layer serving as the heat insulating elastic layer 32 having a thickness of 2.0 mm was formed on an SUM core metal 31 having an outer diameter of 8 mm. The silicon rubber layer serving as the heat insulating elastic layer 32 was formed by adding an acrylonitrile balloon as a hollow resin having a particle size of 80 μm to the silicon rubber and mixing triethyleneglycol to connect foams with a small amount. A thermal conductivity of the heat insulating elastic layer 32 was 0.12 [W/(m·K)], and a volume heat capacity thereof was $1.1\times10^6$ [J/(m$^3$·K)].

A silicon solid rubber layer serving as the heat storage layer 33 was formed outside the heat insulating elastic layer 32.

That is, the fixing roller 30 used in this experiment is a fixing roller including two silicon rubber layers 32 and 33, in which the heat storage layer is formed as the surface layer of the fixing roller. An outer diameter of the fixing roller 30 is 12 mm, a length L of the rubber portion is 230 mm, and a surface area S of an outer peripheral surface is 8671 mm$^2$.

For the heat storage layer 33, five kinds of silicon rubbers 1 to 5 having different heat capacities were used. Further, the thickness was changed to 50, 150, and 400 μm, and 15 kinds of rollers A1 to A15 having the heat storage layers 33 of different heat capacities were prepared. The outlines of the prepared rollers A1 to A15 are as shown in Table 1.

TABLE 1

| Fixing Roller No. | Heat Storage Layer | Volume Heat Capacity [× $10^3$ J/($m^3$ · K)] | Thickness (μm) | Heat Capacity/ Surface Area [J/($m^2$ · K)] | Thermal Conductivity [W/(m · K)] |
|---|---|---|---|---|---|
| Roller A1 | Rubber 1 | 1.25 | 50 | 63 | 0.3 |
| Roller A2 | Rubber 2 | 1.47 | 50 | 74 | 0.3 |
| Roller A3 | Rubber 3 | 1.54 | 50 | 77 | 0.3 |
| Roller A4 | Rubber 4 | 1.74 | 50 | 87 | 0.3 |
| Roller A5 | Rubber 5 | 2.10 | 50 | 105 | 0.3 |
| Roller A6 | Rubber 1 | 1.25 | 150 | 188 | 0.3 |
| Roller A7 | Rubber 2 | 1.47 | 150 | 221 | 0.3 |
| Roller A8 | Rubber 3 | 1.54 | 150 | 231 | 0.3 |
| Roller A9 | Rubber 4 | 1.74 | 150 | 261 | 0.3 |
| Roller A10 | Rubber 5 | 2.10 | 150 | 315 | 0.3 |
| Roller A11 | Rubber 1 | 1.25 | 400 | 500 | 0.3 |
| Roller A12 | Rubber 2 | 1.47 | 400 | 588 | 0.3 |
| Roller A13 | Rubber 3 | 1.54 | 400 | 616 | 0.3 |
| Roller A14 | Rubber 4 | 1.74 | 400 | 696 | 0.3 |
| Roller A15 | Rubber 5 | 2.10 | 400 | 840 | 0.3 |

The rubbers 1 to 5 are solid rubbers in which silica having a particle size of 4 μm to 6 μm and alumina having a particle size of 4 μm to 6 μm are blended into a silicon rubber as a filler in a range of 10% by mass to 50% by mass in total, such that desired volume heat capacity and thermal conductivity are rendered.

After the recording material P, on which the unfixed toner image T was formed, passed through the fixing apparatus 7, fixing performance was estimated.

In a state where the temperature of the heater 21, the fixing roller 30, and the overall fixing apparatus is familiar with an ambient temperature, the experiment is started (hereinafter, this condition is referred to as 'cold start'). The experiment was carried out at temperature 25° C. and humidity 60%.

Figure 14:
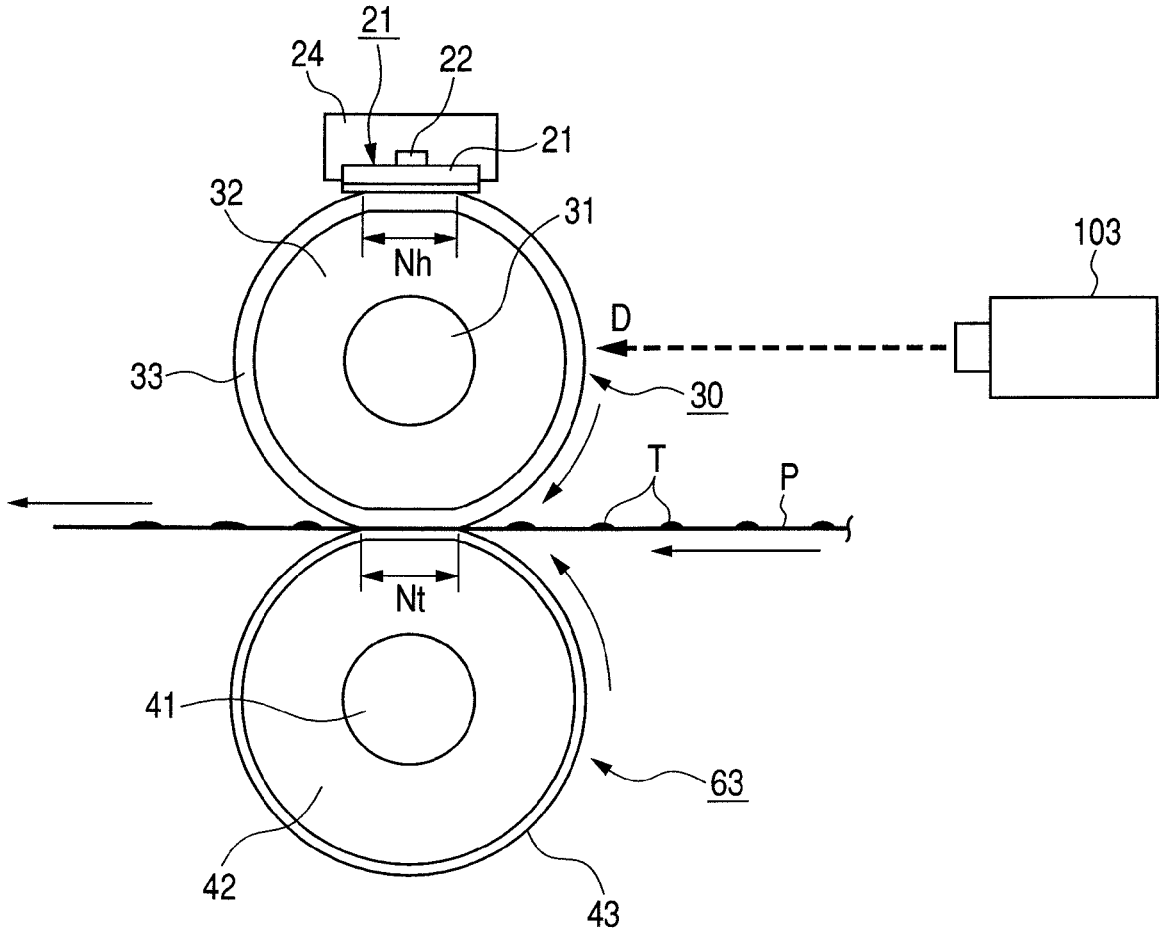
FIG. 14 is an explanatory view of a way to measure a surface temperature of a fixing roller.

In regards to the surface temperature of the fixing roller 30, as shown in FIG. 14, the surface temperature of the fixing roller 30 at an intermediate portion D between the heating contact region Nh to the fixing nip portion Nt along the rotation direction of the fixing roller 30 is measured by using a non-contact radiation thermometer 103.

From the cold start, at the same time period the fixing roller 30 starts to be rotated, 500 W power is applied to the ceramic heater 21 to cause heat generation of the ceramic heater 21. Then, the fixing roller 30 is heated to increase the temperature of the fixing roller 30 to a target temperature.

The temperature of the fixing roller 30 is controlled by using the radiation thermometer 103. After the fixing roller 30 reaches a desired temperature, power supply to the ceramic heater 30 is controlled such that the target temperature is maintained.

After the warm-up time period of 20 seconds elapsed, the recording material P on which the unfixed toner image T was formed was passed therethrough. The experiment was carried out while varying the target temperature of the fixing roller 30 and varying the temperature of the ceramic heater 21 subjected to temperature control. Then, the temperature of the fixing roller 30 at which fixability of a heated and fixed image on the recording material P becomes satisfactory was measured.

In order to estimate the fixing performance of the unfixed toner image T on the recording material P, a cellophane tape was attached to the toner image on the recording material P after heating and fixing, and after being pressed with a surface pressure of 0.49 N/$cm^2$ (50 g/$cm^2$) for 1 minute, the cellophane tape was peeled off. The estimation was performed according to a degree of defective image in the toner image (a degree of detachment by the tape).

A case where the degree of defective image exceeds 5% of the original toner image was called NG (defective). As the recording material P, a paper having a basic weight of 75 g/$mm^2$, for example, 4024 manufactured by XEROX Corporation, was used.

The experiment was carried out by means of an experimental apparatus for 15 kinds of rollers A1 to A15 each having the heat storage layer 33 of a different heat capacity, and the relationships between the heat capacity and the temperature of the fixing roller were compared.

Figure 15:
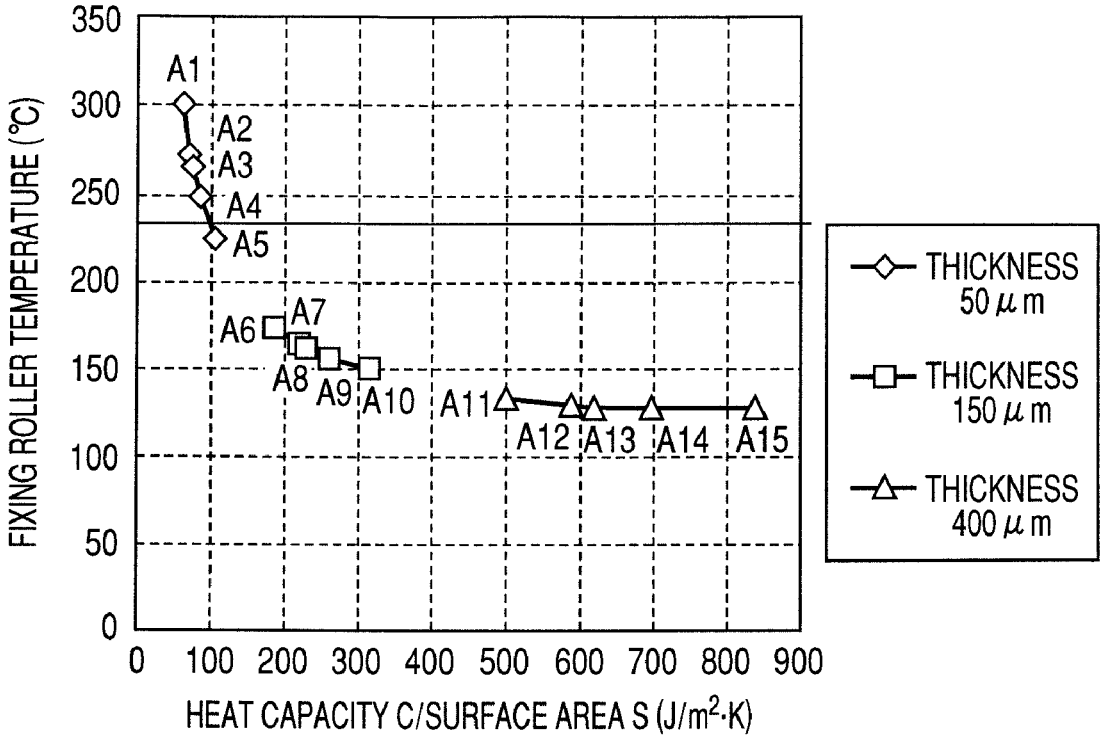
FIG. 15 is a graph illustrating a relationship between a heat capacity per unit surface area of a heat storage layer of a fixing roller and a fixing roller temperature for heating and fixing.

The result is shown in FIG. 15. In FIG. 15, the vertical axis represents the surface temperature of the fixing roller for satisfactory fixing performance when the recording material is passed therethrough, and the horizontal axis represents the ratio (C/S) of the heat capacity (C) of the heat storage layer to the unit surface area (S) of the fixing roller. Even if the heat storage layers have the same thickness, one made of rubber having small volume heat capacity is rendered small heat capacity. If the heat capacity/surface area (C/S) becomes small, the surface temperature of the fixing roller for satisfactory fixing performance is increased. This results from the following expression.

Heat amount $Q$=Heat capacity $C$×Temperature $T$

As the heat capacity of the heat storage layer 33 becomes smaller, in order to save a heat amount for melting and fixing toner per unit surface area of the recording material P, the surface of the fixing roller needs to be raised to a high temperature.

If the heat capacity/surface area is smaller than 100 J/(m$^2$·K), the surface temperature of the fixing roller for fixing toner exceeded 230° C. This exceeds a heat-resistant temperature at which silicon rubber used in the heat storage layer 33 or the heat insulating elastic layer 32 is successively available. If the rubber continues to be heated at a temperature higher than the heat-resistant temperature, the cross-linkage of the rubber may be destroyed. Further, recoupling may occur, hardness may be changed, and then the rubber may be destroyed. Therefore, in order to obtain satisfactory fixability and ensure a stable operation with no failure, it is necessary to use the fixing roller 30 having the heat storage layer 33 satisfying the condition that the heat capacity/surface area is not less than 100 J/(m$^2$·K).

If the heat capacity/surface area becomes larger, the surface temperature of the fixing roller for satisfactory fixability was lowered. However, even if the heat capacity/surface area was larger than 600 J/(m$^2$·K), the surface temperature of the fixing roller for satisfactory fixability was not changed. That is, when the heat capacity/surface area is larger than 600 J/(m$^2$·K), the heat storage layer stores an excess heat amount. Further, since the heat storage layer stores a large heat amount, energy needed for the heater to heat the fixing roller is increased.

As described above, the fixing roller 30 needs to be used at a temperature not more than 230° C. If the required surface temperature of the fixing roller is increased, the heater needs to be raised to a higher temperature. A large amount of power is needed to increase the temperature of the heater itself. Further, the heater and the peripheral parts need to have heat resistance, which results in an increase in cost. In addition, the temperature of the entire image forming apparatus is increased due to heat dissipation from the fixing apparatus, and if the temperature near the developing device 3 is increased, an unused developer in the developing device 3 may be melted or deteriorated. In order to use the fixing roller 30 at as low a temperature as possible, it is effective to increase the heat capacity.

However, when the temperature of the fixing roller (the temperature of the heat storage layer) is excessively lowered, even if the heat amount for fixing toner is stored, toner fixability becomes unsatisfactory. This is because, if the temperature of the fixing roller is low, the temperature gradient of the fixing roller and the recording material becomes small, and the thermal conductivity from the fixing roller to the recording material (toner) is lowered.

Figure 27A:
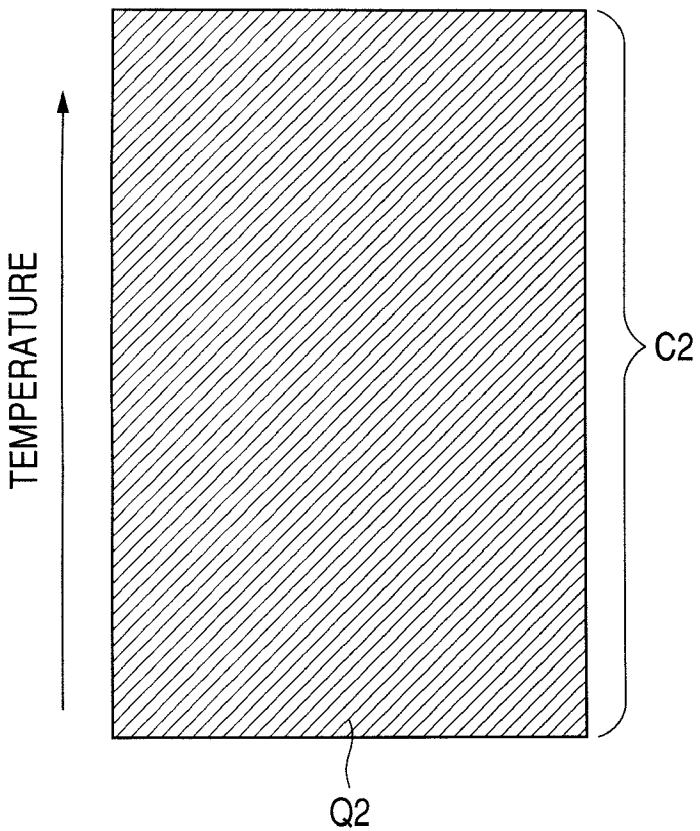
FIGS. 27A, 27B and 27C are images illustrating a case where a heat capacity of a heat storage layer is excessively large
Figure 27B:
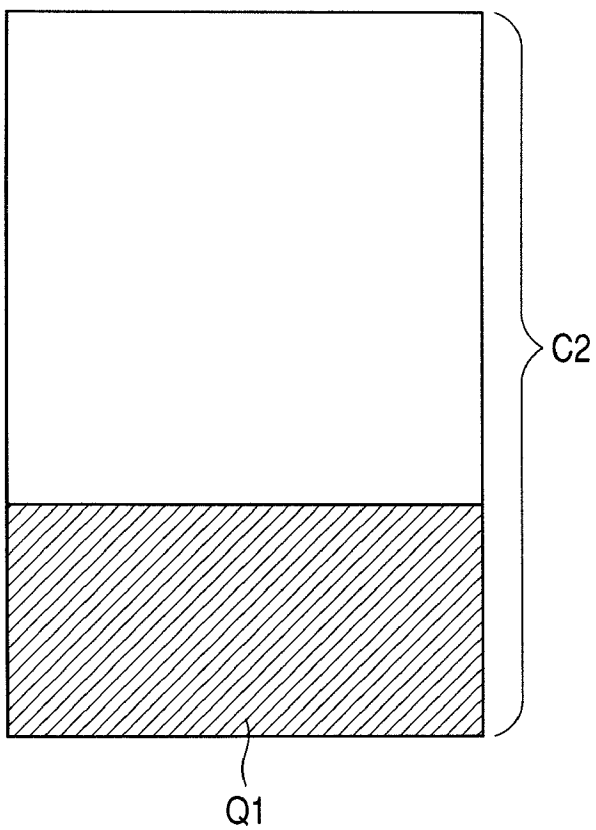
Figure 27C:
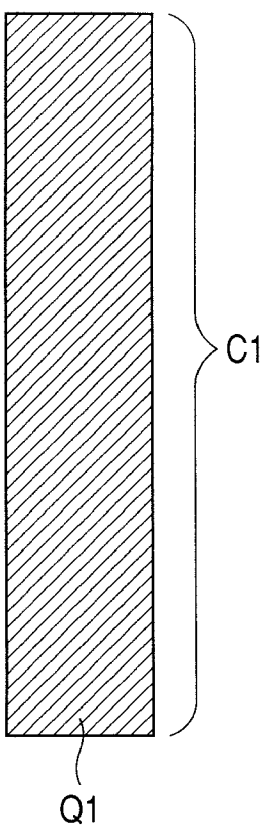

FIGS. 27A, 27B, and 27C are conceptual views illustrating a comparison result of a heat amount actually stored in the heat storage layer with the heat capacity of the heat storage layer of the fixing roller. In FIGS. 27A, 27B, and 27C, the vertical axis represents the temperature of the heat storage layer of the fixing roller. FIGS. 27A and 27B illustrate a case where the heat capacity of the heat storage layer of the fixing roller is excessively large (the heat capacity C/S per unit surface area is larger than 600 J/(m$^2$·K)). FIG. 27C illustrates a case where the heat capacity of the heat storage layer of the fixing roller is appropriate (C/S is not more than 600 J/(m$^2$·K)). FIG. 27A illustrates a model in which a useless heat amount is stored since a heat capacity C2 is large and a heat storage amount Q2 is large. FIG. 27B illustrates a model in which only a heat amount Q1 required for fixing toner is stored in the heat storage layer having high heat capacity. In this case, since the temperature of the fixing roller is lowered, the temperature gradient of the fixing roller and the recording material becomes small, and the heat storage amount is difficult to be transferred to the recording material (toner). FIG. 27C illustrates a model in which only a heat amount Q1 required for fixing toner is stored in the heat storage layer having an appropriate heat capacity C1. In this case, an excess heat amount other than the heat amount required for fixing toner becomes small, and the temperature of the fixing roller is appropriately high. Accordingly, the temperature gradient of the fixing roller and the recording material becomes large, and the heat storage amount is easily transferred to the recording material (toner). The fixing roller according to the embodiment of the present invention is an apparatus having a heat storage layer similar to the model shown in FIG. 27C.

The heat storage amount per unit surface area of the fixing roller may be calculated by the expression 'Heat capacity of fixing roller/Surface area×Fixing roller temperature'.

Figure 16:
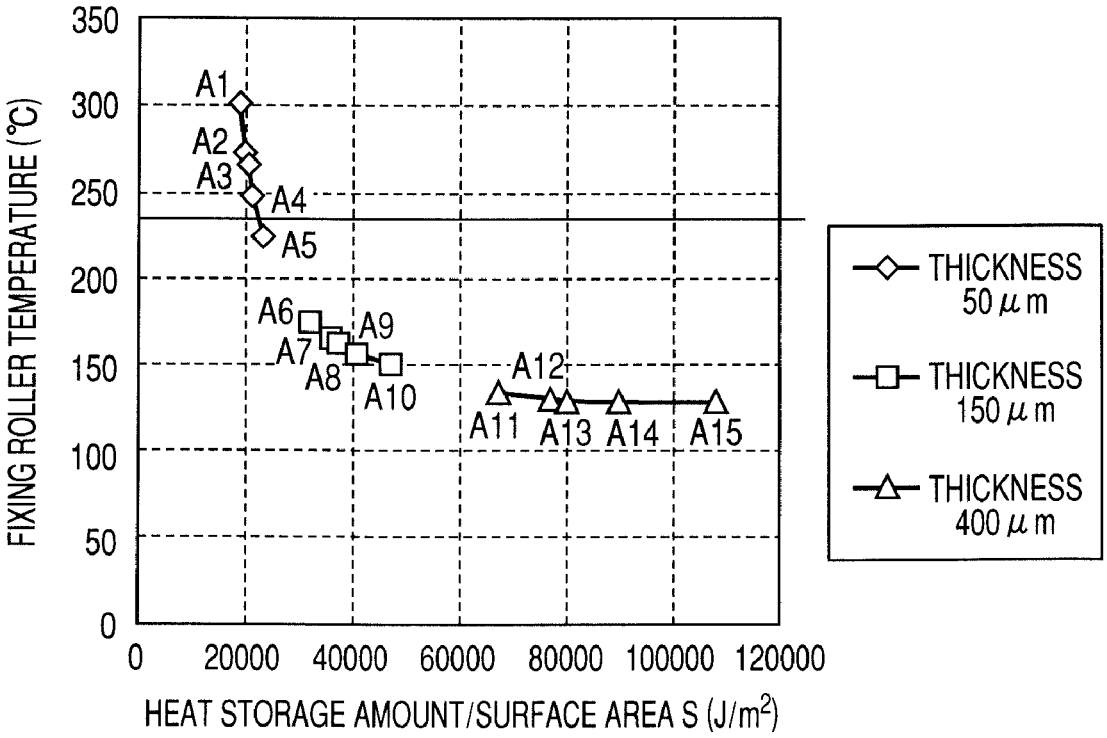
FIG. 16 is a graph illustrating a relationship between a heat storage amount per unit surface area of a heat storage layer of a fixing roller and a fixing roller temperature for heating and fixing.

The result of the experiment 1 is converted into a relationship between a fixing roller temperature required for securing toner fixability and a heat storage amount required for securing toner fixability, and is shown in FIG. 16. In FIG. 16, the vertical axis represents the temperature required for fixing, and the horizontal axis represents the heat storage amount per unit surface area of the fixing roller.

Here, the fixing rollers A13, A14, and A15 require the same fixing temperature as that of the fixing roller A12. That is, they have an excess heat storage amount.

These fixing rollers have a large heat capacity uselessly, and stores useless heat which does not contribute to toner fixing, which cause the waste of energy. In the fixing rollers A13, A14, and A15, the heat capacity/surface area is larger than 600 J/(m$^2$·K).

That is, in order to minimize the waste of energy during the fixing operation, it is necessary to use a fixing roller having a heat storage layer 33 satisfying the condition that the heat capacity/surface area is not more than 600 J/(m$^2$·K).

Experiment 2

Next, the heat storage layer 33 of the fixing roller 30 was formed only by changing the thickness of the heat storage layer 33, and a comparative experiment was carried out.

In this experiment, a fixing roller 30 was used in which a silicon rubber layer serving as a heat insulating elastic layer 32 is formed on an SUM core metal 31 having an outer diameter of 8 mm to have a thickness of 2.0 mm. The silicon rubber layer serving as the heat insulating elastic layer 32 was formed by adding an acrylonitrile balloon as a hollow resin having a particle size of 80 μm to a silicon rubber and mixing triethyleneglycol to connect foams with a small amount. The thermal conductivity of the heat insulating elastic layer 32 was 0.12 [W/(m·K)], and the volume heat capacity thereof was $1.1\times10^6$ [J/(m$^3$·K)].

A silicon solid rubber layer serving as a heat storage layer 33 having a thermal conductivity of 0.3 W/(m·K) and a volume heat capacity of $1.5\times10^6$ J/(m$^3$·K) was formed outside the heat insulating elastic layer 32.

By changing the thickness of the heat storage layer 33, 7 kinds of fixing rollers A16 to A22 having the heat storage layers 33 of different heat capacities were prepared. The outlines of the heat storage layer 33 of the prepared fixing rollers A16 to A22 are as shown in Table 2.

TABLE 2

| Fixing Roller No. | Heat Storage Layer | Volume Heat Capacity [× $10^3$ J/($m^3$ · K)] | Thickness (μm) | Heat Capacity/ Surface Area [J/($m^2$ · K)] | Thermal Conductivity [W/(m · K)] |
|---|---|---|---|---|---|
| Roller A16 | Rubber 5 | 2.10 | 30 | 63 | 0.3 |
| Roller A17 | Rubber 5 | 2.10 | 50 | 105 | 0.3 |
| Roller A18 | Rubber 5 | 2.10 | 75 | 158 | 0.3 |
| Roller A19 | Rubber 5 | 2.10 | 120 | 252 | 0.3 |
| Roller A20 | Rubber 5 | 2.10 | 190 | 399 | 0.3 |
| Roller A21 | Rubber 5 | 2.10 | 280 | 588 | 0.3 |
| Roller A22 | Rubber 5 | 22.10 | 350 | 735 | 0.3 |

Figure 17:
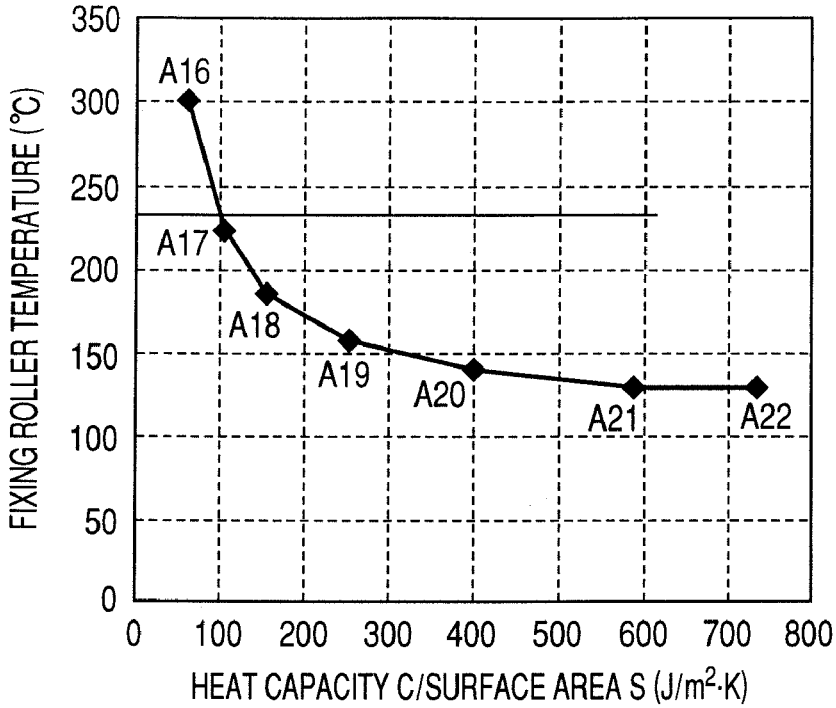
FIG. 17 is a graph illustrating a relationship between a heat capacity per unit surface area of a heat storage layer of a fixing roller and a fixing roller temperature for heating and fixing.

The experiment was carried out in the same manner as the experiment 1, and for the fixing rollers, the fixing roller temperature for satisfactory fixability was measured. The result is shown in FIG. 17. In FIG. 17, the vertical axis represents the surface temperature of the fixing roller for satisfactory fixing performance when the recording material P is passed therethrough. The horizontal axis represents the ratio (C/S) of the heat capacity C of the heat storage layer to the unit surface area S of the fixing roller.

Similarly to the experiment 1, when the heat capacity/surface area becomes small, the surface temperature of the fixing roller for satisfactory fixing performance is increased. If the heat capacity/surface area is smaller than 100 J/($m^2$·K), the required surface temperature of the fixing roller surface exceeds 230° C. Further, even if the heat capacity/surface area becomes larger than 600 J/($m^2$·K), the surface temperature of the fixing roller for satisfactory fixing performance was not changed.

In order to achieve satisfactory fixability and ensure a stable operation with no failure, it is necessary to use a fixing roller having a heat storage layer satisfying the condition that the heat capacity/surface area is not less than 100 J/($m^2$·K). In order to minimize the waste of energy during the fixing operation, it is necessary to use a fixing roller 30 having a heat storage layer 33 satisfying the condition that the heat capacity/surface area is not more than 600 J/($m^2$·K).

Experiment 3

From the experiments 1 and 2, it can be seen that, if the heat storage layer 33 satisfying the condition that the heat capacity C/S is in a range of 100 J/($m^2$·K) to 600 J/($m^2$·K), damage can be prevented, and the heat amount required for heating and fixing the recording material can be efficiently stored.

By providing a heat storage layer 33 having an appropriate heat capacity C/S with respect to contact time period of the fixing roller 30 and the recording material P, a heat amount required for heating and fixing the recording material can be efficiently stored. This will be described below.

The experiment was carried out by changing the contact time period of the fixing roller 30 and the recording material. A process speed of the used image forming apparatus was 100 mm/sec, and a laser beam printer which prints 16 sheets of recording materials per minute was used.

In this experiment, 5 kinds of experimental apparatuses were used while the pressure force between the fixing roller 30 and the pressure roller 63 varied. In the experimental apparatuses, the widths of the fixing nib portions Nt (the width in the recording material conveying direction) were 6.0 mm, 5.0 mm, 4.0 mm, 3.0 mm, and 2.0 mm, respectively.

In the experimental apparatuses, fixing nip time periods t for which the recording material and the fixing roller 30 come into contact with each other in the fixing nip portion Nt per rotation of the fixing roller are 0.06, 0.05, 0.04, 0.03, and 0.02 [second], respectively. That is, the time periods t needed for one portion of the surface of the fixing roller to pass through the fixing nip portion are 0.06, 0.05, 0.04, 0.03, and 0.02 [second], respectively.

The same experiment as the experiment 1 was carried out by using the fixing rollers A17 to A21 used in the experiment 2.

Figure 18:
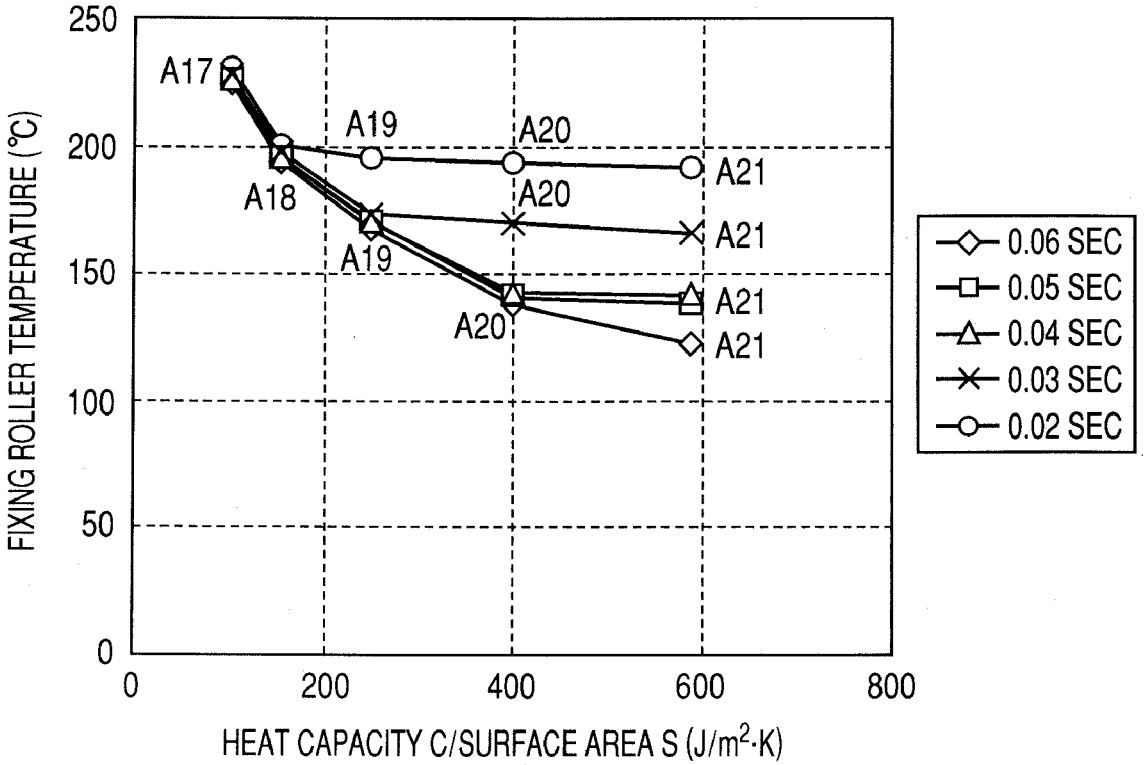
FIG. 18 is a graph illustrating a relationship between a heat capacity per unit surface area of a heat storage layer of a fixing roller and a fixing roller temperature for heating and fixing during each time period when a fixing roller and a recording material come into contact with each other.

The result is shown in FIG. 18. In FIG. 18, the vertical axis represents the fixing roller temperature required for fixing. The horizontal axis represents the ratio (C/S) of the heat capacity C to the unit surface area S of the used fixing roller. The relationship between the fixing temperature and the heat capacity of the heat storage layer was illustrated for the experimental apparatuses used in the experiment having different contact time periods of the fixing roller and the recording material.

In the experimental apparatus in which the contact time period of the fixing roller and the recording material is 0.06 [second], if the fixing roller has large heat capacity C/S, the fixing roller temperature required for fixing is lowered. For example, the fixing roller A21 can fix at approximately 120° C. However, even if the same fixing roller is used, in the experimental apparatus in which the fixing nip time period is 0.02 [second], the temperature required for fixing was approximately 190° C. In the same kind of fixing rollers, the higher the fixing roller temperature is, the large the heat storage amount is. When the fixing roller A21 and the experimental apparatus in which the fixing nip time period is 0.02 [second] are combined, the heat storage amount required for fixing is increased.

As described above, the heat storage amount per unit surface area of the fixing roller may be calculated by the following expression.

Heat capacity of fixing roller/Surface area×Fixing roller temperature

Figure 19:
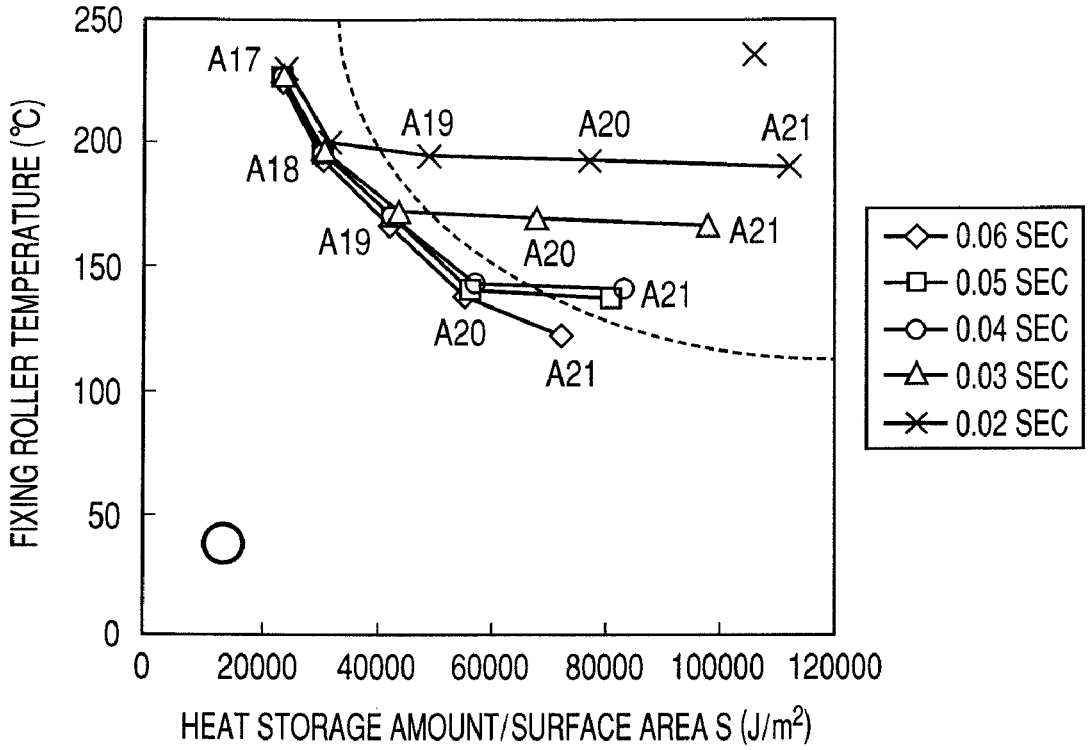
FIG. 19 is a graph illustrating a relationship between a heat storage amount per unit surface area of a heat storage layer of a fixing roller and a fixing roller temperature for heating and fixing during each time period when a fixing roller and a recording material come into contact with each other.

The result of the experiment 3 is converted into a relationship between the fixing roller temperature required for fixing and the heat storage amount required for fixing, and is shown in FIG. 19. In FIG. 19, the vertical axis represents the fixing roller temperature required for fixing, and the horizontal axis represents the heat storage amount per unit surface area of the fixing roller. The results by the experimental apparatuses having different fixing nip time periods were shown. As apparent from FIG. 19, in order to secure satisfactory fixability, the shorter the time period needed for one portion of the surface of the fixing roller to pass through the fixing nip portion is, the larger the heat amount to be stored per unit surface area needs to be. That is, the higher the processing speed of the printer is, the more the heat amount to be stored per unit surface area is.

Here, in the experimental apparatus in which the contact time period of the fixing roller and the recording material is 0.02 [second], the fixing rollers A19, A20, and A21 require the same fixing temperature as that of the fixing roller A18, which results in deterioration of power saving. Similarly, in the experimental apparatus in which the contact time period is 0.03 [second], power saving in the fixing rollers A20 and A21 is deteriorated. Further, in the experimental apparatus in which the contact time period is 0.05 [second], power saving in the fixing roller A21 is deteriorated.

In FIG. 19, in view of power saving, a best combination of a fixing roller and an apparatus includes a fixing roller in a lower left region from a broken line (o region) and an apparatus having mounted thereon the fixing roller.

As described above, the combinations of the fixing rollers and the apparatuses may be divided into those having excellent power saving and others.

Figure 20:
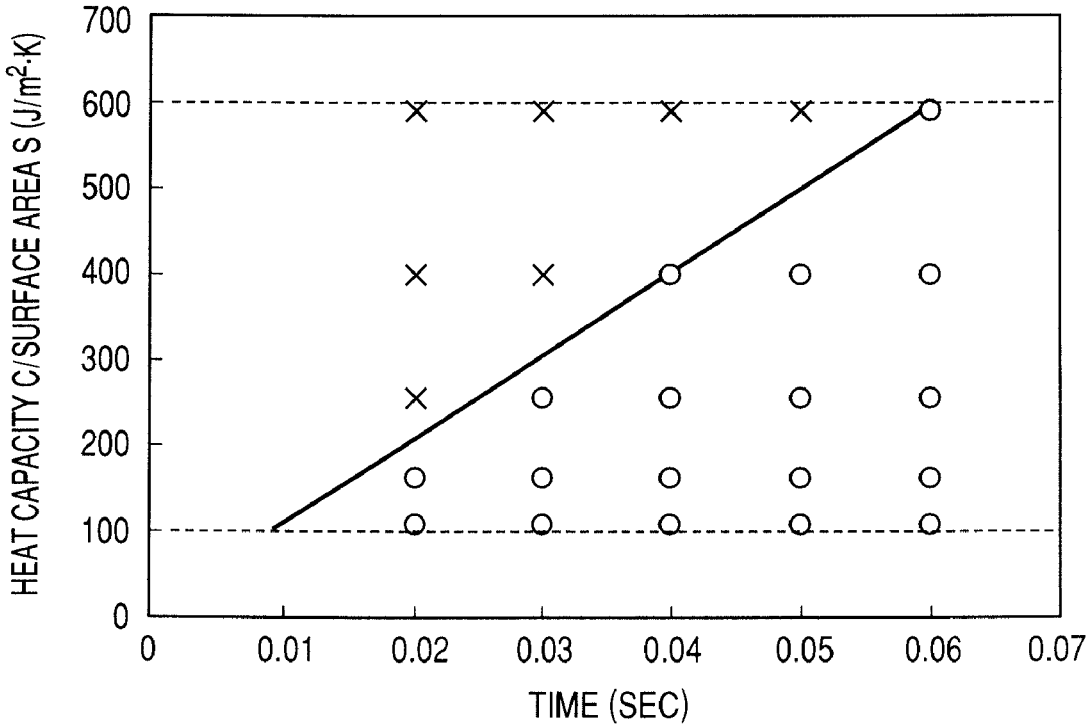
FIG. 20 is a graph illustrating efficient and inefficient combinations between a heat storage amount per unit surface area of a heat storage layer of a fixing roller and a contact time period of a recording material.

The result is shown by a graph of FIG. 20. In FIG. 20, the horizontal axis represents 'the contact time period of the fixing roller and the recording material per rotation in the experimental apparatus used'. The vertical axis represents 'the ratio (C/S) of the heat capacity C to the surface area S of the fixing roller'. In FIG. 20, an efficient combination was marked with '○', and an inefficient combination was marked with 'x'. In FIG. 20, the 0 and x regions may be divided by a line. The 0 region may be represented by the following expression:

$$C/S \leqq 10000[J/(s \cdot m^2 \cdot K)] \times t[s].$$

Here, t denotes the contact time period of the fixing roller and the recording material in the fixing apparatus, that is, the time period needed for one portion of the surface of the fixing roller to pass through the fixing nip portion.

That is, if the relationship between the heat capacity C/S of the heat storage layer 33 of the fixing roller 30 and the time period t of the fixing apparatus to be used satisfies the condition $C/S \leqq 10000[J/(s \cdot m^2 \cdot K)] \times t[s]$ within the range of $100[K)] \leqq C/S \leqq 600[J/(m^2 \cdot K)]$, an efficient combination of a fixing apparatus and a fixing roller capable of effectively using the heat storage amount may be implemented.

Experiment 4

As described above, if a fixing roller having large heat capacity is mounted on an experimental apparatus in which the contact time period of the fixing roller and the recording material is long, the fixing roller temperature required for fixing is lowered. However, if the fixing roller is mounted on an experimental apparatus in which the contact time period of the fixing roller and the recording material is short, the effect is not exerted, and the fixing roller temperature required for fixing is high. As a result, this combination is inefficient since low-temperature fixing cannot be performed despite a large heat storage amount.

A mechanism of such phenomenon will be described by way of the following experiment result.

A thermocouple was attached onto the recording material, and an increase in the temperature of the recording material was measured while the fixing roller and the recording material come in contact with each other in the fixing nib portion. For example, in the fixing roller A19 and the fixing roller A20, the temperature was adjusted to 165° C., warming-up was carried out in the same manner as in the experiment 3, and the recording material was passed therethrough.

Figure 21:
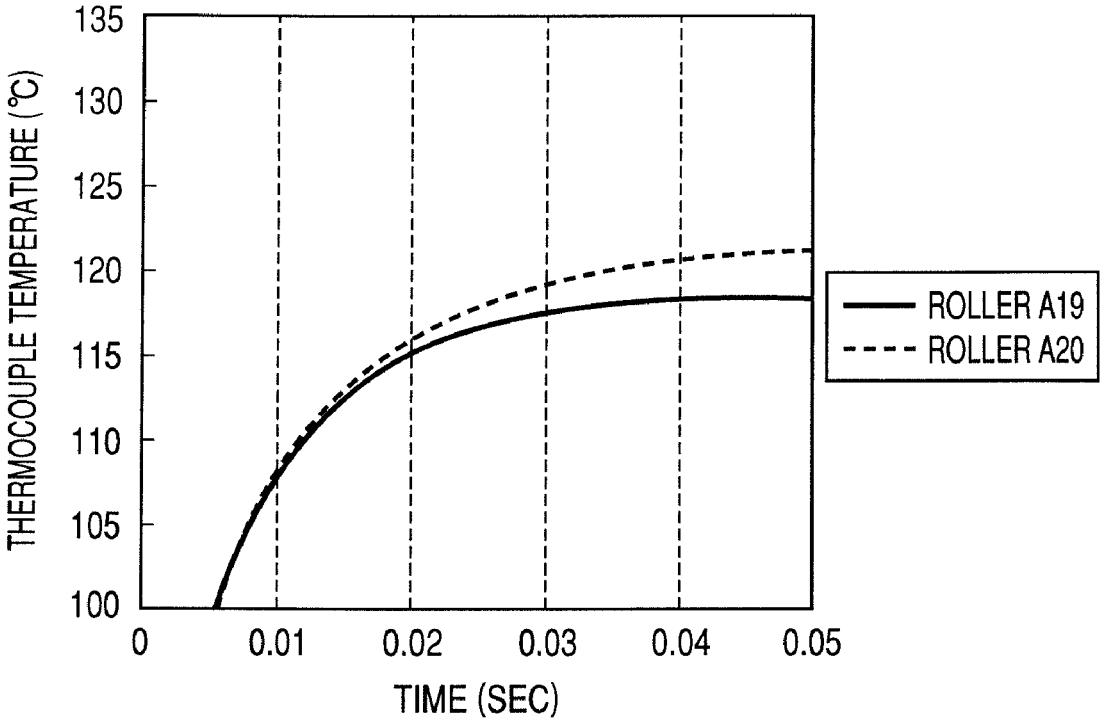
FIG. 21 is a graph illustrating an increase in temperature of a thermocouple on a recording material that comes into contact with a fixing roller.

The result is shown in FIG. 21. The vertical axis represents the temperature of the thermocouple attached onto the recording material, and the horizontal axis represents the time period elapsed (second) after the recording material enters the fixing nib portion.

In the roller A19 and the roller A20, similarly, the thermocouple on the recording material was increased in temperature for 0.02 [second] after the recording material entered the fixing nib portion. Thereafter, however, in the roller A19, the temperature slowly increases, and at a point of time period 0.05 [second], it is observed, a temperature difference between the temperature measure by the thermocouples of the roller A19 and the roller A20.

In the roller A19, the heat capacity of the heat storage layer is small, and the heat storage amount is small, as compared with the roller A20. Accordingly, heat is robbed from the fixing nib portion, and the heat transfer to the recording material becomes slow. In the roller 20 having large heat capacity, heat is continuously supplied to the recording material.

As such, the fixing roller having large heat capacity and heat storage amount exerts significant effects for a long contact time period.

If the fixing nib is narrow and the contact time period of the fixing roller and the recording material is merely 0.02 [second], a roller having small heat capacity exerts the same effects.

The fixing roller having large heat capacity requires a lot of energy to be elevated to a given temperature, as compared with the fixing roller having small heat capacity. Accordingly, a large amount of power is consumed during being elevated, and the warm-up time period is also extended. In the experimental apparatus in which the contact time period of the fixing roller and the recording material is short, the fixing roller having large heat storage amount may store even a useless heat amount.

As described above, in the heat fixing apparatus for heating the heating roller from the outside thereof, the heat storage layer is provided near the surface of the fixing roller, the inside of which is of a small heat capacity. Further, the heat capacity/surface area of the heat storage layer 33 of the fixing roller 30 is in a range equal to or more than $100[J/(m^2 \cdot K)]$ and equal to or less than $600[J/(m^2 \cdot K)]$. Therefore, the fixing roller can store a sufficient heat amount for heating and fixing the recording material while having small heat capacity, and can effectively use the heat amount stored therein. In addition, the fixing roller can be stably used with no failure.

The relationship between the heat capacity/surface area of the heat storage layer 33 of the fixing roller 30 and the contact time period of the recording material and the fixing roller 30 per rotation of the fixing roller is represented by the following expression:

$$C/S \leqq 10000[J/(s \cdot m^2 \cdot K)] \times t[s].$$

Accordingly, the heat fixing apparatus can store the heat amount to be transferred to the recording material for a given contact time period only in the surface layer of the fixing roller, the inside of which is of a small heat capacity. Further, the heat fixing apparatus can realize low energy consumption and short warm-up time period.

When the heat fixing apparatus has a plurality of heating modes having different contact time periods with the recording material per rotation of the fixing roller 30, that is, when an apparatus can set a plurality of heating modes having different peripheral speeds of the fixing roller (heating member), setting may be performed as follows. That is, in a heating mode in which the contact time period of the fixing roller and the recording material is shortest (the peripheral speed of the fixing roller is fastest), when a time period needed for one portion of the surface of the fixing roller to pass through the fixing nip portion is t, a heat capacity C/S of the heat storage layer 33 per unit surface area of the fixing roller may satisfy the following condition:

$$C/S[\mathrm{J/(m^2 \cdot K)}] \leqq 10000[\mathrm{J/(s \cdot m^2 \cdot K)}] \times t[s].$$

It is assumed that a printer has two heating modes, for example, a heating mode 1 in which a contact time period of a fixing roller having a process speed of 100 mm/sec and the recording material is t1, and a heating mode 2 in which a contact time period of a fixing roller having a process speed of 50 mm/sec and the recording material is t2. In both modes, if the width of the fixing nip portion is the same, the contact time period t1 is shorter than the contact time period t2. Accordingly, a fixing roller satisfying the following condition may be mounted on the printer:

$$C/S \leqq 10000[\mathrm{J/(s \cdot m^2 \cdot K)}] \times t1[s].$$

If the heat capacity/surface area of the heat storage layer 33 is increased suitably for the contact time period t2 during the heating mode 1 in which the contact time period with the recording material is long, there is no case where the heat amount to be stored is transferred for the short contact time period t1 during the heating mode 1. If heat is stored in the heat storage layer 33 suitably for the contact time period t1, in both the heating mode 1 and the heating mode 2, the heat amount of the heat storage layer 33 can be effectively used. Therefore, the heat fixing apparatus can realize low energy consumption and short warm-up time period.

Second Embodiment

Figure 22:
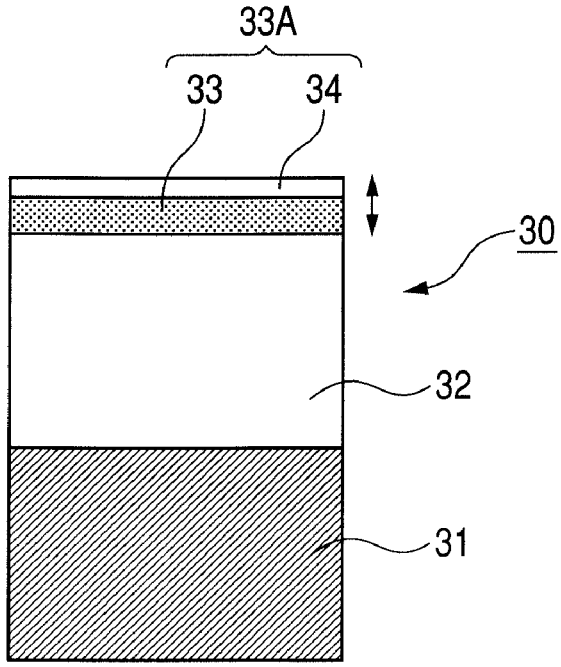
FIG. 22 is a schematic cross-sectional view (1) illustrating a layer construction of a fixing roller according to a second embodiment of the present invention.

FIG. 22 is a schematic cross-sectional view illustrating the construction of a fixing roller 30 according to this embodiment.

This embodiment is the same as the first embodiment, excluding the construction of the fixing roller 30. Specifically, the fixing roller 30 includes a heat insulating elastic layer 32 formed on a core metal 31, a heat storage elastic layer 33 made of silicon rubber outside the heat insulating elastic layer 32, and a release layer 34 as an outermost layer (uppermost layer).

The heat storage elastic layer 33 and the release layer 34 form a heat storage layer 33A. The heat capacity of the heat storage layer 33A per unit surface area of the fixing roller is in a range of 100 J/(m$^2$·K) to 600 J/(m$^2$·K).

The thermal conductivities of the heat storage elastic layer 33 and the release layer 34 of the heat storage layer 33A are higher than the thermal conductivity of the heat insulating elastic layer 32. The thermal conductivity of the heat insulating elastic layer 32 is not more than 0.20 W/(m·k).

Figure 23:
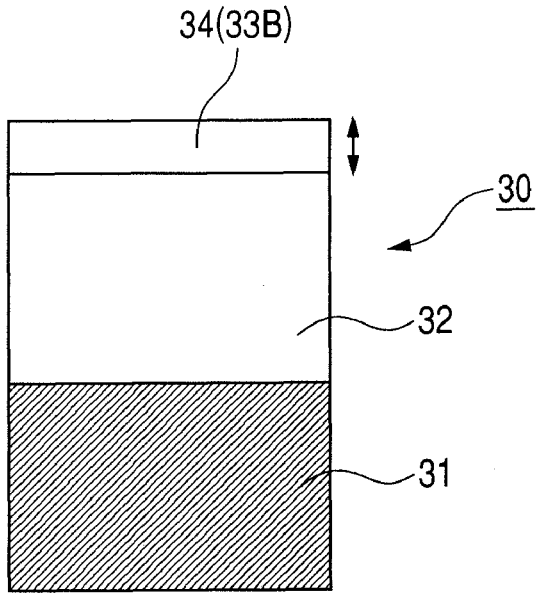
FIG. 23 is a schematic cross-sectional view (2) illustrating the layer construction of the fixing roller according to the second embodiment.

As shown in FIG. 23, only a release layer 34 may be formed outside the heat insulating elastic layer 32 such that a heat capacity per unit surface area of the fixing roller is in a range equal to or more than 100 J/(m$^2$·K) and equal to or less than 600 J/(m$^2$·K), thereby forming a heat storage layer 33B.

The thermal conductivity and the heat capacity of the heat storage layer 33A or 33B is measured by the following method. A test piece of vertical 5 mm and horizontal 5 mm including the surface of the fixing roller is cut out from the heat storage layer 33A or 33B in the surface layer of the fixing roller, the heat capacity and the thermal conductivity in the thickness direction of the surface layer 33A or 33B is calculated by the same measurement method (FIG. 4) as the above-described heat storage layer 33.

The release layer 34 may be a layer in which a high thermal conductive filler is mixed in a rubber material, such as silicon rubber or fluorine rubber, or a base resin material, such as a fluorine compound. Specifically, a layer in which 10% by mass to 50% by mass of a powdery high thermal conductive filler having a thermal conductivity of not less than 10 W/(m·K) is mixed in a base resin material, thereby forming a high thermal conductive release layer.

The base resin material may include, for example, fluorine resin, polyphenylene sulfide, polysulphone, polyetherimide, polyether sulphone, polyether ketone, liquid crystal polyester, polyamide-imide, and polyimide.

The fluorine resin may include, for example, polytetrafluoroethylene (PTFE) resin, tetrafluoroethylene-perfluoroalkylvinyl ether copolymer (PFA) resin, fluoroethylene-polypropylene copolymer (FEP) resin, polyvinylidene fluoride (PVDF) resin, and polyvinyl fluoride (PVF) resin.

The high thermal conductive release layer 34 made of fluorine resin is formed by fluorine resin coating or fluorine resin tube.

The coating may be formed of latex or Daiel (Trademark, manufactured by Daikin Industries, Ltd., fluorinated latex) by dip coating with dispension, or spray coating.

The high thermal conductive filler may include, for example, diamond, graphite, carbon, carbon nanotube, boron nitride, metal oxide, alloys, AlN, and crystalline silica.

Any filler material may be used insofar as a high thermal conductivity can be rendered. In addition, the filler may have any shape. Regardless of the filler material and the shape of the filler, the object of this embodiment can be accomplished.

In this embodiment, the uppermost layer of the fixing roller 30 is formed of a composition in which a high thermal conductive filler is blended into a fluorine compound. Accordingly, a thermal conductivity required for the uppermost layer of the heating member 30 can be accomplished, and the uppermost surface of the heating member can be rendered releasability. Therefore, an image forming apparatus can be stably operated.

When an adhesive layer needs to be provided between the high thermal conductive solid rubber layer 33 and the high thermal conductive release layer 34, a high thermal conductive filler may be distributed into the adhesive layer, thereby forming a high thermal conductive adhesive layer.

With this construction, even if the release layer 34 is provided on the uppermost surface of the fixing roller 30, a fixing apparatus can reduce the warm-up time period and short first print-out time period, and accomplish power saving.

Experiment 5

In order to confirm the above-described effects, release layer 34 made of fluorine resin was formed on the surface of the fixing roller, and an experiment was carried out.

The construction excluding the fixing roller is the same as the experiment 1. A process speed of an image forming apparatus used is 100 mm/sec, and a laser beam printer which prints 16 sheets of recording materials per minute is used. Further, the width of the heating contact region Nh is 7 mm, and the width of the fixing nip portion Nt is 7 mm.

In view of the construction, the fixing roller 30 used in the experiment 1 is obtained by forming a fluorine resin layer serving as the release layer 34 to have a thickness of 15 μm on the outermost layer of each of the fixing rollers A16 to A22.

That is, a silicon rubber layer serving as the heat insulating elastic layer 32 having a thermal conductivity of 0.12 W/(m·K) and a volume heat capacity of $1.1\times10^6$ J/($m^3$·K) is formed to have a thickness of 2 mm on an SUM core metal 31 having a thickness of 8 mm. Further, a silicon solid rubber layer serving as the heat storage layer 33 having a thermal conductivity of 0.3 W/(m·K) and a volume heat capacity of $1.5\times10^6$ J/($m^3$·K) is formed outside the silicon rubber layer while varying the thickness. In addition, the release layer 34 is provided outside the silicon solid rubber layer.

In respects to the fluorine resin layer serving as the release layer 34, pure fluorine resin usually has low thermal conductivity of approximately 0.2 W/(m·K). In this experiment, PFA was used as the fluorine resin. A high thermal conductive fluorine resin having a volume heat capacity of $2.0\times10^3$ J/($m^3$·K) and a thermal conductivity 0.3 W/(m·K) was used in which alumina having a particle size 4 to 6 μm is mixed in the PFA as a thermal conductive filler in a range of 10 to 50 parts by weight.

The outlines of the prepared fixing rollers are as shown in Table 3.

TABLE 3

| Fixing Roller No. | Release Layer | Heat Storage Elastic Layer | Heat Storage Elastic Layer Thickness (μm) | Heat Capacity/ Surface Area [J/($m^2$ · K)] |
|---|---|---|---|---|
| Roller A23 | PFA | Rubber 5 | 30 | 93 |
| Roller A24 | PFA | Rubber 5 | 50 | 135 |
| Roller A25 | PFA | Rubber 5 | 75 | 188 |
| Roller A26 | PFA | Rubber 5 | 100 | 282 |
| Roller A27 | PFA | Rubber 5 | 200 | 450 |
| Roller A28 | PFA | Rubber 5 | 300 | 618 |
| Roller A29 | PFA | Rubber 5 | 400 | 765 |

Figure 24:
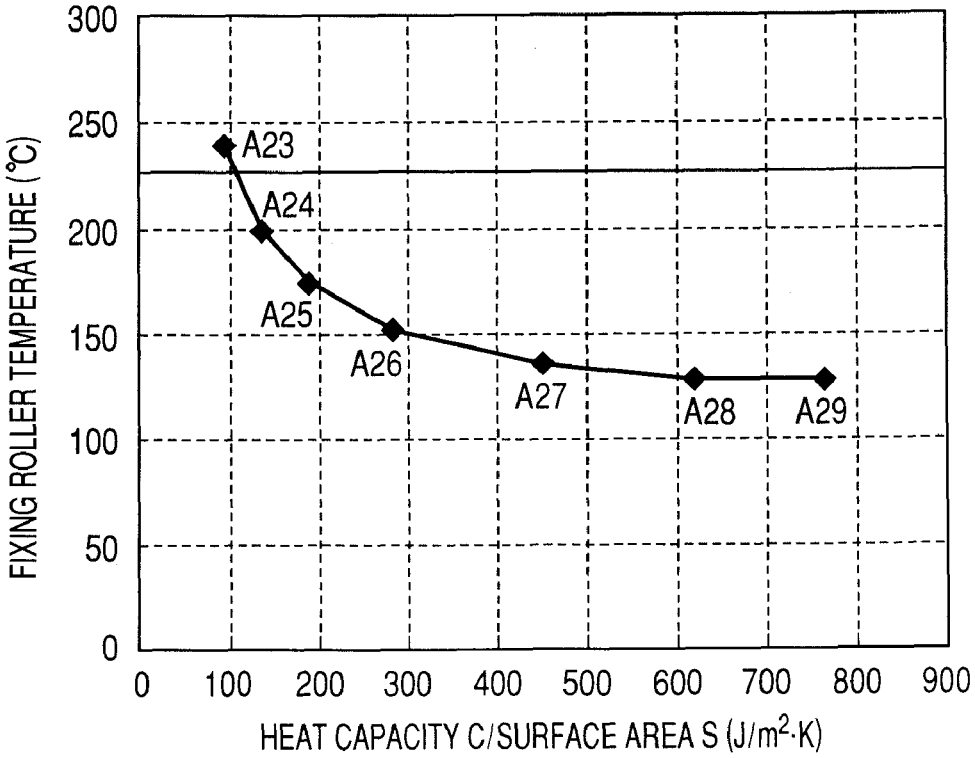
FIG. 24 is a graph illustrating a relationship between a heat capacity per unit surface area of a heat storage layer of a fixing roller and a fixing roller temperature for heating and fixing.

The same experiment as that in the experiment 1 was carrier out by using the fixing rollers A23 to A29. The experiment result is shown in FIG. 24. The vertical axis represents the ratio (C/S) of the heat capacity C of the heat storage layer to the unit surface area S of the fixing roller, and the vertical axis represents the surface temperature of the fixing roller for satisfactory fixing performance when the recording material is passed therethrough.

Similarly to the experiment 1 in the first embodiment, if the heat capacity/surface area is not more than 100 J/($m^2$·K), the required surface temperature of the fixing roller exceeded 230° C. Further, if the heat capacity/surface area is not less than 600 J/($m^2$·K), the surface temperature of the fixing roller for satisfactory fixing performance was not changed.

As described above, in this embodiment, the high thermal conductive release layer 34 is provided on the outermost layer of the fixing roller 30. Therefore, a fixing roller can have excellent releasability and slidability.

Even if the fluorine resin layer is provided on the uppermost layer, similarly to the first embodiment, the heat capacity/surface area of the heat storage layer of the fixing roller is in a range equal to or more than 100 J/($m^2$·K) and equal to or less than 600 J/($m^2$·K). Therefore, damage can be prevented, and a fixing operation can be stably performed. Further, a fixing roller can effectively use the heat amount stored therein.

Third Embodiment

Figure 25:
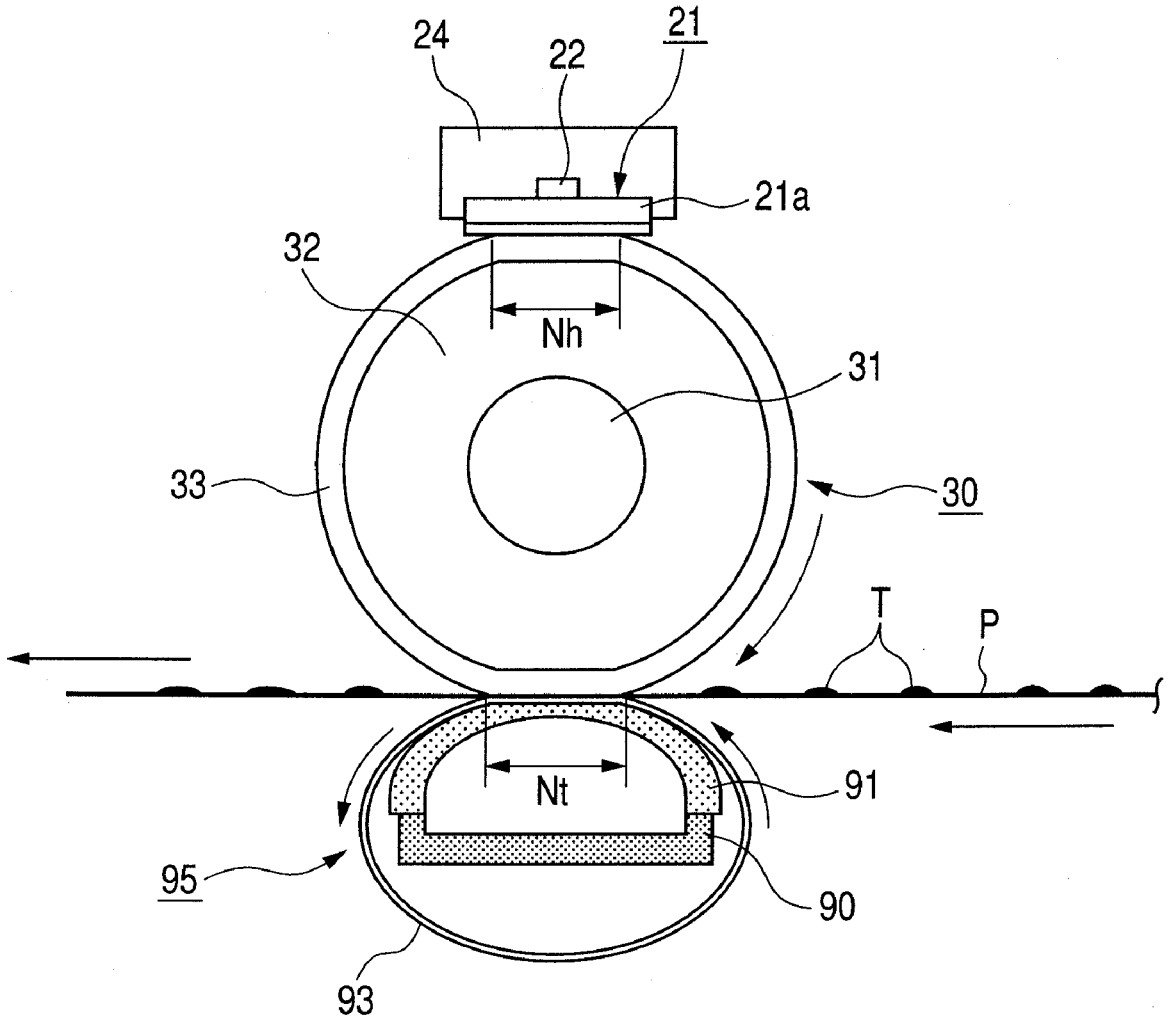
FIG. 25 is a schematic cross-sectional view of a fixing apparatus according to a third embodiment of the present invention.

This embodiment is the same as the first embodiment. However, as shown in FIG. 25, a pressure member 95 which forms the fixing nip portion Nt with the fixing roller 30 has a plate-shaped pressure member 90/91, and a film 93 which is engaged with the plate-shaped pressure member 90/91 and rotates the periphery of the plate-shaped pressure member 90/91 according to the rotation of the fixing roller 30.

The plate-shaped pressure member 90/91 is obtained by, for example, forming a heat insulating portion or a heat insulating layer 91 on a support 90 made of an SUM material. The film 93 having small heat capacity and low thermal conductivity is engaged with the outer periphery of the plate-shaped pressure member 90/91.

The pressure member 95 and the fixing roller 30 come into contact with each other with a given pressure, thereby forming the fixing nip portion Nt. In the fixing nip portion Nt, the surface of the fixing roller and the film 93 rotate in association with each other to pinch and convey the recording material P, and applies heat and pressure to the recording material to fix the toner image on the recording material.

The heat insulating layer 91 may be an elastic member made of, for example, silicon rubber or fluorine rubber. However, since the fixing roller surface is an elastic member, even if the heat insulating layer 91 is a rigid member, the fixing nip portion Nt can be secured. That is, the heat insulating layer 91 may be a rigid member made of heat insulating resin, such as liquid crystal polymer, phenol resin, PPS, PEEK, polyimide, polyamide-imide, or fluorine resin.

The lower the thermal conductivity of the pressure member 95 is, the faster the surface temperature of the fixing roller is increased. Accordingly, the heat insulating layer 91 may have lower thermal conductivity.

When the heat insulating layer 91 is an elastic heat insulating layer, for example, a balloon-containing silicon elastic layer made of an organo polysiloxane composition, in which a hollow filler is mixed, or an organo polysiloxane composition containing water-absorbing polymer and water is suitably used. Alternatively, a foam-containing silicon elastic layer or a silicon sponge elastic layer formed by foaming silicon rubber is suitably used.

When the heat insulating layer 91 is a rigid heat insulating layer, if the contact surface with the fixing roller 30 is planarized, the fixing nip portion Nt can be planarized, thereby accomplishing excellent conveyability of the recording material. For the rigid heat insulating layer, a low thermal conductive resin material containing a hollow filler, for example, glass balloon or silica balloon, is also suitably used.

The film 93 is formed by, for example, providing a release layer made of fluorine resin having a thickness of approximately 10 μm to 30 μm on a base layer made of a high heat insulating and low thermal conductive resin material, such as PPS, polyimide, or polyamide-imide, having a thickness of approximately 30 μm to 100 μm.

Since the film 93 has small heat capacity and low thermal conductivity, there is little the escape of heat to the film 93 and the heat dissipation from the film surface to the air. An anti-friction made of silicon oil is disposed between the plate-shaped pressure member 90/91 and the film 93 to improve slidability of the film.

The effects of this embodiment are the same as those in the first embodiment. Further, the fixing apparatus using the plate-shaped pressure member according to this embodiment has a simple construction. Therefore, the fixing apparatus can be compact and accomplish small heat capacity. In addition, heat loss due to the heat dissipation to the air can be made small, as compared with the pressure roller. Further, the warm-up time period can be reduced and power saving can be accomplished.

As described above, according to this embodiment, it is possible to provide a fixing apparatus that can reduce the warm-up time period and a short first print-out time period, accomplish power saving, and realize excellent image quality.

Fourth Embodiment

Figure 26:
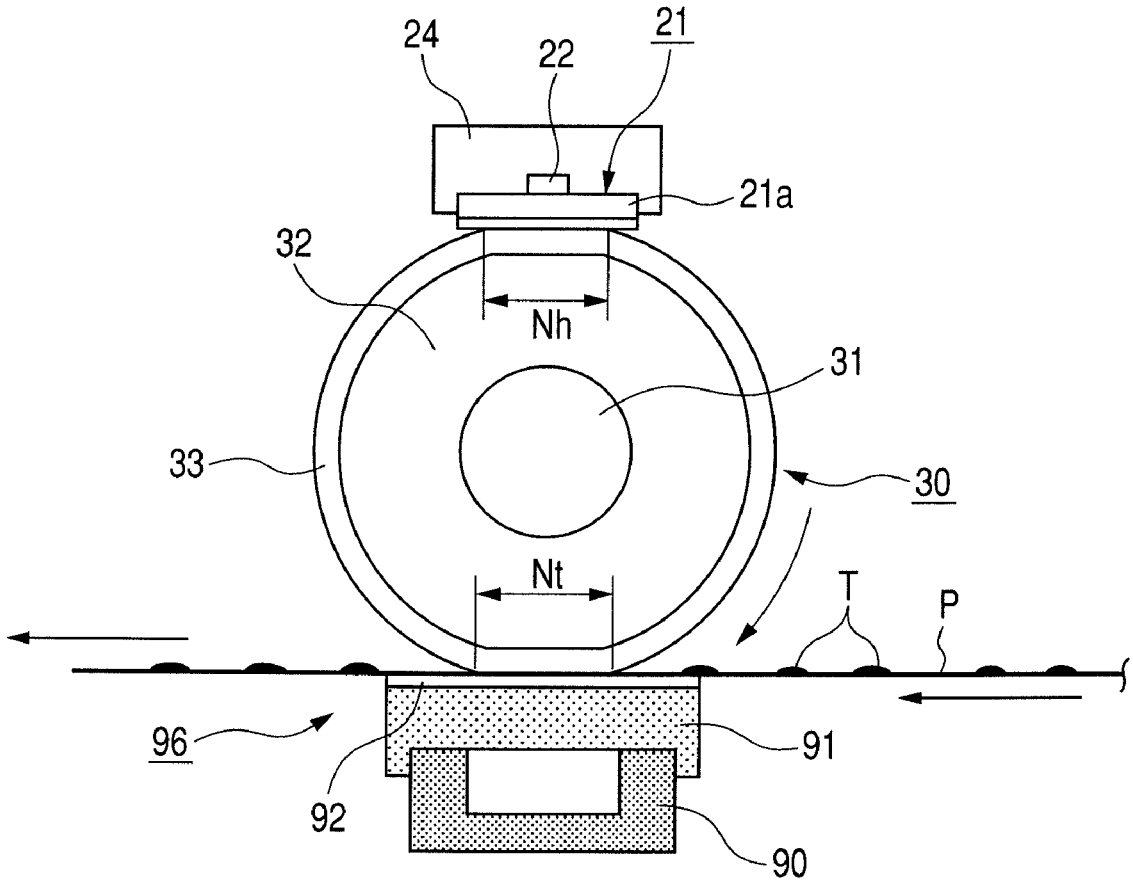
FIG. 26 is a schematic cross-sectional view of a fixing apparatus according to a fourth embodiment of the present invention.

This embodiment is the same as the third embodiment, excluding the construction of the pressure member. In this embodiment, as shown in FIG. 26, a pressure member 96 is a plate-shaped pressure member that comes into slidable contact with the fixing roller 30. The film 93 in the third embodiment is not provided.

The plate-shaped pressure member 90/91/92 is prepared by, for example, forming a heat insulating member or a heat insulating layer 91 on a support 90 made of an SUM material, and forming a sliding release layer 92.

The sliding release layer 92 may be formed of a material having excellent slidability so as not to interfere with the conveyance of the recording material P, or a material having excellent releasability so as to prevent toner transferred to the fixing roller from sticking. For example, a fluorine resin-based sheet may be adhered or coated, thereby forming the sliding release layer.

In this embodiment, as the surface layer 33 of the fixing roller 30, for example, a high thermal conductive elastic layer formed by blending a high thermal conductive filler in silicon rubber or fluorine rubber is suitably used. In this way, a high thermal conductivity and a frictional force required for conveying the recording material can be obtained.

If the surface of the fixing roller is adapted to have a high frictional coefficient, the recording material can be conveyed by the surface of the fixing roller.

The fixing roller 30 and the pressure member 96 come into contact with each other with a given pressure, thereby forming the fixing nip portion Nt. In the fixing nip portion Nt, the recording material is conveyed by the fixing roller surface according to a difference in frictional force between the surface of the fixing roller and the plate-shaped pressure member 90/91/92. Then, heat and pressure are applied to the recording material to fix the toner image on the recording material.

The effects of this embodiment are the same as those in the first embodiment. Further, the fixing apparatus using the plate-shaped pressure member according to this embodiment has a simple construction. Therefore, the fixing apparatus can be compact and accomplish small heat capacity. In addition, the fixing roller 30 and the plate-shaped pressure member come into contact with only in the fixing nip portion Nt, and heat insulated from each other. For this reason, heat loss due to the heat transfer to the pressure member 96 and the heat dissipation to the air can be made as small as possible. Further, the warm-up time period can be reduced and power saving can be accomplished.

As described above, according to this embodiment, it is possible to provide a fixing apparatus that can reduce the warm-up time period and a short first print-out time period, accomplish power saving, and realize excellent image quality.

Like the fourth embodiment, if the pressure member is a plate-shaped member that comes into contact with the heating member in the same area, the heat dissipation from the pressure member can be suppressed, and the apparatus can have small heat capacity. Then, low power consumption and a short first print-out time period can be accomplished.

As described in the foregoing embodiments, occurrence of heating irregularity (fixing irregularity) can be suppressed, and the warm-up time period or the first print-out time period can be reduced. Further, power consumption can be reduced. That is, the low thermal conductive elastic layer is provided in the heating member, and the heat storage layer is formed outside the low thermal conductive elastic layer as the uppermost layer. In this case, the heat capacity per unit surface area of the fixing member is in a range equal to or more than 100 $[J/(m^2 \cdot K)]$ and equal to or less than 600 $[J/(m^2 \cdot K)]$. Accordingly, heat transferred from the external heating unit to the surface of the heating member can be stored near the surface layer of the heating member such an extent that the image on the recording material can be sufficiently heated and fixed.

Appropriate heat capacity is given near the surface of the heating member. For this reason, the surface temperature of the heating member required for heating the image on the recording material can be set within a temperature range higher than toner on the recording material without exceeding a heat insulating temperature at which the elastic layer made of silicon rubber forming the fixing roller is successively available. Therefore, the fixing roller can store a sufficient heat amount for heating and fixing the recording material while having small heat capacity, and can effectively use the heat amount stored therein. In addition, the fixing roller can be stably used with no failure.

The relationship between the heat capacity/surface area C/S of the heat storage layer of the fixing roller and the contact time period t of the recording material and the fixing roller 30 per rotation of the fixing roller satisfies the condition $C/S[J/(m^2 \cdot K)] \leqq 10000[J/(s \cdot m^2 \cdot K)] \times t[s]$. Accordingly, a heat amount to be transferred to the recording material for a given contact time period can be stored only near the surface layer of the fixing roller, the inside of which is of a small heat capacity. Therefore, it is possible to provide a heat fixing apparatus that can realize low energy consumption and reduce the warm-up time period.

The low thermal conductive elastic layer is provided below the heat storage layer. Accordingly, the escape of heat to the core metal of the heating member can be suppressed, and the rising speed of the surface temperature of the heating member can be increased. A time period required for increasing the surface temperature of the heating member to a temperature required for fixing. In addition, if the low thermal conductive layer is an elastic member, close-contactness of the surface of the heating member to the image becomes satisfactory, and satisfactory image quality free from heating irregularity can be obtained.

1) The heating unit or the pressure member may be pressed into contact with and separated from the fixing roller by a contact/separate mechanism. Accordingly, while the fixing apparatus is running, the heating unit or the pressure member may be pressed into contact with the fixing roller at a predetermined control timing. Further, while the fixing apparatus is not running, the heating unit or the pressure member may be separated from the fixing roller. Therefore, it is possible to prevent permanent set of the elastic layer of the fixing roller due to such a state that the heating unit or the pressure member is always pressed into contact with the fixing roller.

2) The rotatable heating member for heating the image on the recording material in the nip portion is not limited to the rollers according to the embodiments. For example, a flexible endless belt may be used.

3) The heating unit for heating the heating member from the outside thereof may be a non-contact type, such as an infrared lamp or an electromagnetic induction type heating unit, which is arranged to be not in contact with the heating member.

4) The image heating apparatus of the present invention is not limited to the heat fixing apparatus according to the embodiments. The image heating apparatus can be widely used as apparatuses for heating a recording material bearing an image, for example, an image heating apparatus for heating a recording material bearing an image to thereby reform a surface property, such as a gloss, and an image heating apparatus for performing temporal fixing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-120516, filed May 1, 2007, and Japanese Patent Application No. 2008-104577, filed Apr. 14, 2008, which are hereby incorporated by reference herein in their entirety.

What is claimed is:

1. An image heating apparatus that heats a toner image on a recording material, the image heating apparatus includes:

a rotatable heating member, the surface of which comes into contact with the toner image, the heating member having a elastic layer having a heat insulation performance and a heat storage layer, which is provided outside the elastic layer and includes at least one layer;

a nip forming member that forms a nip portion to pinch and convey the recording material with the heating member; and a heater for heating the heating member from the outside thereof, wherein a heat capacity C/S per a unit surface area of the heat storage layer is in a range equal to or more than 100 $J/(m^2 \cdot K)$ and equal to or less than 600 $J/(m^2 \cdot K)$, and wherein a thermal conductivity of the elastic layer is not more than 0.20 W/(m·K).

2. The image heating apparatus according to claim 1, wherein, if a time period needed for one portion of the surface of the heating member to pass through the nip portion is t, the heat capacity C/S per unit surface area of the heat storage layer satisfies the condition $C/S[J/(m^2 \cdot K)] \leqq 10000[J/(s \cdot m^2 \cdot K)] \times t[s]$.

3. The image heating apparatus according to claim 1, wherein the apparatus has a plurality of heating modes with different peripheral speeds of the heating member, and during a heating mode with fastest peripheral speed of the heating member, if a time period needed for one portion of the surface of the heating member to pass through the nip portion is t, the heat capacity C/S per unit surface area of the heat storage layer satisfies the condition $C/S\ [J/(m^2 \cdot K)] \leqq 10000[J/(s \cdot m^2 \cdot K)] \times t[s]$.

4. The image heating apparatus according to claim 1, wherein a thickness of the heat storage layer is in a range equal to or more than 30 μm and equal to or less than 400 μm.

5. A heating member that is employed by an image heating apparatus, the heating member includes:

a heat insulating elastic layer; and a heat storage layer that is provided outside the elastic layer and has at least one layer, wherein the image heating apparatus includes a rotatable heating member, the surface of which comes into contact with a toner image on a recording material, a nip forming member that forms a nip portion to pinch and convey the recording material with the heating member, and a heater for heating the heating member from the outside thereof, wherein a heat capacity C/S per unit surface area of the heat storage layer is in a range equal to or more than 100 $J/(m^2 \cdot K)$ and equal to or less than 600 $J/(m^2 \cdot K)$ and wherein a thermal conductivity of the elastic layer is not more than 0.20 W/(m·K).

6. The heating member according to claim 5, wherein a thickness of the heat storage layer is in a range equal to or more than 30 μm and equal to or less than 400 μm.

* * * * *